US010651551B2

(12) United States Patent
Biancotto et al.

(10) Patent No.: US 10,651,551 B2
(45) Date of Patent: May 12, 2020

(54) ANTENNA RADOME-ENCLOSURES AND RELATED ANTENNA STRUCTURES

(71) Applicant: CommScope Technologies LLC, Hickory, NC (US)

(72) Inventors: Claudio Biancotto, Edinburgh (GB); Craig Mitchelson, Cumbernauld (GB); Shuwei Russell, Falkirk (GB); David Walker, Edinburgh (GB)

(73) Assignee: CommScope Technologies LLC, Hickory, NC (US)

( * ) Notice: Subject to any disclaimer, the term of this patent is extended or adjusted under 35 U.S.C. 154(b) by 168 days.

(21) Appl. No.: 15/808,252

(22) Filed: Nov. 9, 2017

(65) Prior Publication Data

US 2018/0159211 A1 Jun. 7, 2018

Related U.S. Application Data

(60) Provisional application No. 62/430,654, filed on Dec. 6, 2016.

(51) Int. Cl.

| | |
|---|---|
| ***H01Q 1/42*** | (2006.01) |
| ***H01Q 1/12*** | (2006.01) |
| *H01Q 9/04* | (2006.01) |

(52) U.S. Cl.

CPC ..... *H01Q 1/42* (2013.01); *H01Q 1/12* (2013.01); *H01Q 9/0407* (2013.01)

(58) Field of Classification Search

CPC ..... H01Q 1/40; H01Q 1/42; H01Q 1/242

See application file for complete search history.

(56) References Cited

U.S. PATENT DOCUMENTS

| | | | | |
|---|---|---|---|---|
| 4,191,959 | A * | 3/1980 | Kerr | H01Q 9/0428 343/700 MS |
| D653,654 | S | 2/2012 | Thomson et al. | |
| D654,910 | S | 2/2012 | Thomson et al. | |
| D655,278 | S | 3/2012 | Thomson et al. | |
| 8,558,746 | B2 | 10/2013 | Thomson et al. | |
| D705,748 | S | 5/2014 | He | |
| D716,752 | S | 11/2014 | Katori et al. | |
| D730,880 | S | 6/2015 | Nagata et al. | |
| D732,472 | S | 6/2015 | Laffon et al. | |
| D768,607 | S | 10/2016 | Altonen et al. | |

(Continued)

FOREIGN PATENT DOCUMENTS

KR 10-2010-0021876 2/2010

OTHER PUBLICATIONS

Notification of Transmittal of the International Search Report and the Written Opinion of the International Searching Authority, or the Declaration, in corresponding PCT Application No. PCT/US2017/060846(14 pages) (dated Feb. 27, 2018).

*Primary Examiner* — Dieu Hien T Duong

(74) *Attorney, Agent, or Firm* — Myers Bigel, P.A.

(57) ABSTRACT

An antenna structure includes a radiator element and an enclosure housing the radiator element therein. The enclosure includes a front face that is adjacent a surface of the radiator element and sidewall surfaces that house the radiator element therebetween. The front face of the enclosure has an internal surface that is bounded by the sidewall surfaces and an external surface that is opposite the internal surface. The surface of the radiator element is positioned closer to the external surface than the internal surface of the front face of the enclosure.

22 Claims, 34 Drawing Sheets

(56) References Cited

U.S. PATENT DOCUMENTS

| | | | | |
|---|---|---|---|---|
| D776,657 | S | 1/2017 | Lagerstedt et al. | |
| D785,608 | S | 5/2017 | Weaver et al. | |
| D790,538 | S | 6/2017 | Saimen et al. | |
| D791,123 | S | 7/2017 | Wieser et al. | |
| D794,020 | S | 8/2017 | Homza et al. | |
| D797,099 | S | 9/2017 | Wieser et al. | |
| D797,100 | S | 9/2017 | Wieser et al. | |
| D797,101 | S | 9/2017 | Wieser et al. | |
| D798,860 | S | 10/2017 | Wieser et al. | |
| D799,479 | S | 10/2017 | Wieser et al. | |
| D799,588 | S | 10/2017 | Nanno et al. | |
| 2003/0080906 | A1* | 5/2003 | Miyasaka | G06F 1/1616 343/702 |
| 2008/0001822 | A1* | 1/2008 | Vesterinen | H01Q 1/243 343/700 MS |
| 2008/0252552 | A1 | 10/2008 | Goebel et al. | |
| 2013/0050056 | A1* | 2/2013 | Lee | H01Q 1/2291 343/893 |
| 2014/0118196 | A1* | 5/2014 | Koskiniemi | H01Q 1/42 343/702 |
| 2014/0225802 | A1 | 8/2014 | Huerta et al. | |
| 2014/0253394 | A1 | 9/2014 | Nissinen et al. | |
| 2015/0123872 | A1* | 5/2015 | Fujita | G01S 13/931 343/872 |
| 2017/0271776 | A1 | 9/2017 | Biancotto et al. | |

* cited by examiner

ANTENNA RADOME-ENCLOSURES AND RELATED ANTENNA STRUCTURES

CLAIM OF PRIORITY

This application claims the benefit of and priority under 35 U.S.C. § 119(e) from U.S. Provisional Patent Application No. 62/430,654, entitled "ANTENNA RADOME-ENCLOSURES AND RELATED ANTENNA STRUCTURES" and filed Dec. 6, 2016, in the United States Patent and Trademark Office, the disclosure of which is incorporated by reference herein in its entirety.

FIELD

The present invention relates generally to communications systems and, more particularly, to array antennas utilized in communications systems.

BACKGROUND

Array antenna technology may not be extensively used in the licensed commercial microwave point-to-point or point-to-multipoint market, where more stringent electromagnetic radiation envelope characteristics consistent with efficient spectrum management may be more common. While antenna solutions derived from traditional reflector antenna configurations, such as prime focus fed axi-symmetric geometries, can provide high levels of antenna directivity and gain at relatively low cost, the extensive structure of a reflector dish and associated feed may require enhanced support structure to withstand wind loads, which may increase overall costs. Further, the increased size of reflector antenna assemblies and the support structure required may be viewed as a visual blight.

Array antennas typically utilize printed circuit technology or waveguide technology. The components of the array that interface with free-space, also referred to as the elements, typically utilize microstrip geometries, such as patches, dipoles, and/or slots, or waveguide components such as horns and/or slots. For example, flat panel arrays may be formed using printed slot or waveguide arrays in resonant or travelling wave configurations. The various elements may be interconnected by a feed network, so that the resulting electromagnetic radiation characteristics of the antenna can conform to desired characteristics, such as the antenna beam pointing direction, directivity, and/or sidelobe distribution. The various elements of such array antennas must also be protected from the environment, typically using an antenna enclosure. However, in some instances the antenna enclosure may negatively affect desired electromagnetic characteristics.

SUMMARY

According to some embodiments, an antenna structure includes a radiator element and an enclosure including the radiator element therein. The enclosure includes a front face that is adjacent a surface of the radiator element, and sidewall surfaces that house the radiator element there between. The front face of the enclosure includes an internal surface that is bounded by the sidewall surfaces and an external surface opposite the internal surface. The surface of the radiator element is positioned closer to the external surface than the internal surface of the front face of the enclosure.

In some embodiments, the external and internal surfaces may define a thickness of the front face that varies between the external and internal surfaces.

In some embodiments, the thickness of the front face may include a first thickness adjacent the sidewall surfaces, and a second thickness adjacent the surface of the radiator element, where the first thickness is greater than the second thickness.

In some embodiments, the front face may include a stepped portion between the first thickness and the second thickness.

In some embodiments, the front face may include a tapered or beveled portion between the first thickness and the second thickness.

In some embodiments, the front face may include an integral radome portion having the second thickness adjacent the surface of the radiator element.

In some embodiments, the front face of the enclosure may include an opening extending there through from the external surface to the internal surface. The antenna structure may further include a radome, distinct from the enclosure, on the surface of the radiator element and at least partially exposed by the opening. The radome may have a thickness that is less than a maximum of the thickness of the front face of the enclosure.

In some embodiments, the radome may be formed from or may otherwise include a different material from that of the enclosure.

In some embodiments, the surface of the radiator element including the radome thereon may be recessed relative to the external surface of the front face of the enclosure.

In some embodiments, the front face may include a border portion having the second thickness adjacent an edge of the opening, where the border portion overlaps with a perimeter of the radome.

In some embodiments, the surface of the radiator element including the radome thereon may be coplanar with or may protrude beyond the external surface of the front face of the enclosure.

In some embodiments, the enclosure may include a non-conductive material, and the antenna structure may further include a metallized element adjacent an edge of the surface of the radiator element.

In some embodiments, the metallized element may include respective metal layers on opposing ones of the sidewall surfaces of the enclosure.

In some embodiments, the opposing ones of the sidewall surfaces including the respective metal layers thereon may be oriented to affect the azimuth angle of a coverage pattern of the radiator element.

In some embodiments, the radiator element may be rotatable within the enclosure to alter a polarization thereof.

According to some embodiments, an antenna structure includes a radiator element, an enclosure including the radiator element therein, and a radome. The enclosure includes a front face that is adjacent a surface of the radiator element, and sidewall surfaces that house the radiator element there between. The front face includes an opening extending there through from an external surface thereof to an internal surface thereof that is bounded by the sidewall surfaces. The radome is on the surface of the radiator element and at least partially exposed by the opening in the front face. The surface of the radiator element including the radome thereon protrudes beyond the internal surface and towards the external surface of the front face.

In some embodiments, the radome may have a thickness that is less than a thickness of the front face of the enclosure as defined between the external and internal surfaces thereof.

In some embodiments, the thickness of the front face may include a first thickness adjacent the sidewall surfaces, and a second thickness adjacent the surface of the radiator element that includes the radome thereon, where the first thickness is greater than the second thickness.

In some embodiments, the front face may include a stepped or tapered portion between the first thickness and the second thickness thereof, and a border portion having the second thickness that overlaps with a perimeter of the radome adjacent an edge of the opening.

According to some embodiments, an antenna enclosure includes a plurality of sidewall surfaces configured to house a flat panel antenna element therein, and a front face configured to be positioned adjacent a surface of the flat panel antenna element. The front face includes an internal surface that is bounded by the sidewall surfaces, and an external surface opposite the internal surface. The front face includes a first thickness adjacent the sidewall surfaces and a second thickness adjacent the surface of the radiator element, where the first thickness is greater than the second thickness.

Other structures, devices, and methods according to embodiments described herein will be or become apparent to one with skill in the art upon review of the following drawings and detailed description. It is intended that all such additional structures, devices, and methods be included within this description, be within the scope of the present inventive subject matter, and be protected by the accompanying claims. Moreover, it is intended that features disclosed herein can be implemented separately or combined in any way and/or combination.

BRIEF DESCRIPTION OF THE DRAWINGS

The accompanying drawings, which are incorporated in and constitute a part of this specification, illustrate embodiments of the invention, where like reference numbers in the drawing figures refer to the same feature or element and may not be described in detail for every drawing figure in which they appear and, together with a general description of the invention given above, and the detailed description of the embodiments given below, serve to explain the principles of the invention.

DETAILED DESCRIPTION

Figure 1A:
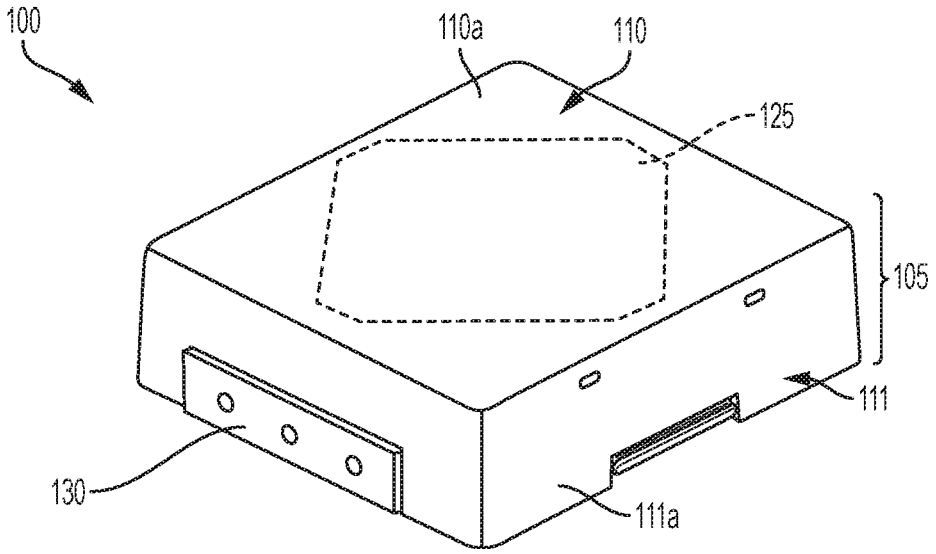
FIG. 1A is a perspective view of an exterior front face of a flat panel antenna structure in accordance with some embodiments.

Some embodiments described herein provide antenna enclosures and methods that allow for improved performance of a flat panel antenna (FPA) using less complex fabrication techniques. In particular, some embodiments provide antenna enclosures having sufficient mechanical strength and/or rigidity to protect the antenna from the operating environment, while simultaneously reducing or minimizing negative effects on the electrical performance of the antenna. This may be achieved in some embodiments by providing an enclosure including a front face having portions or areas of different or varying thicknesses, such that the radiating surface of the antenna or radiator element can be positioned as close as possible to (or even protruding from) the front face of the enclosure.

As described herein, an antenna structure may generally refer to an entire structure that may be mounted to a customer's equipment, including the antenna or radiator element (which transmits/receives electromagnetic radiation) and the enclosure (which protects the radiator element from the operating environment). The enclosure may thus refer to the structure or component that houses or encloses the radiator element to provide environmental protection. A radome may refer to either a portion of the enclosure or a separate component that is arranged in front of or on the radiating aperture or surface of the radiator element. The radome may thus be an integral part of the enclosure (e.g., a single-part or unitary radome-enclosure), or the radome may be stand-alone component of a different material and/or thickness than the enclosure (e.g., a two-part radome-enclosure). In some embodiments, a two-part radome-enclosure includes a thicker enclosure front face/sidewalls and a thinner radome, which is positioned on or adjacent a radiating surface of the antenna or radiator element. The radome may or may not be physically attached to the enclosure in some embodiments.

It will be understood that, as described herein, various attributes of an antenna array, such as beam elevation angle, beam azimuth angle, and half power beam width, may be determined based on the magnitude and/or phase of the signal components that are fed to each of the elements of the antenna array. For example, the magnitude and/or phase of the signal components that are fed to each of the elements may be adjusted so that a flat panel antenna may exhibit a desired antenna coverage pattern in terms of beam elevation angle, beam azimuth angle, half power beam width, etc. The desired frequency range of operation may determine the sizes, dimensions, and/or spacings of the elements of the antenna array. More generally, as described herein, various attributes of an antenna array may be altered by physically adjusting the antenna array housing using one or more mechanical elements, and/or by electronically adjusting the magnitude and/or phase of the signal components that are fed to each of the elements of the antenna array to exhibit a desired antenna coverage pattern in terms of, for example, beam elevation or tilt angle, beam azimuth angle, etc.

Figure 1B:
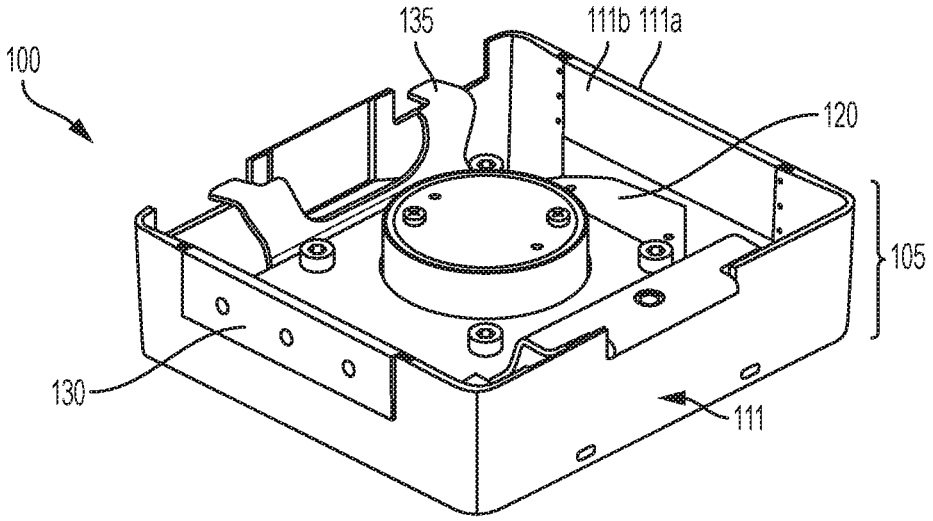
FIG. 1B is a perspective view of an interior of the flat panel antenna structure of FIG. 1A in accordance with some embodiments.
Figure 1C:
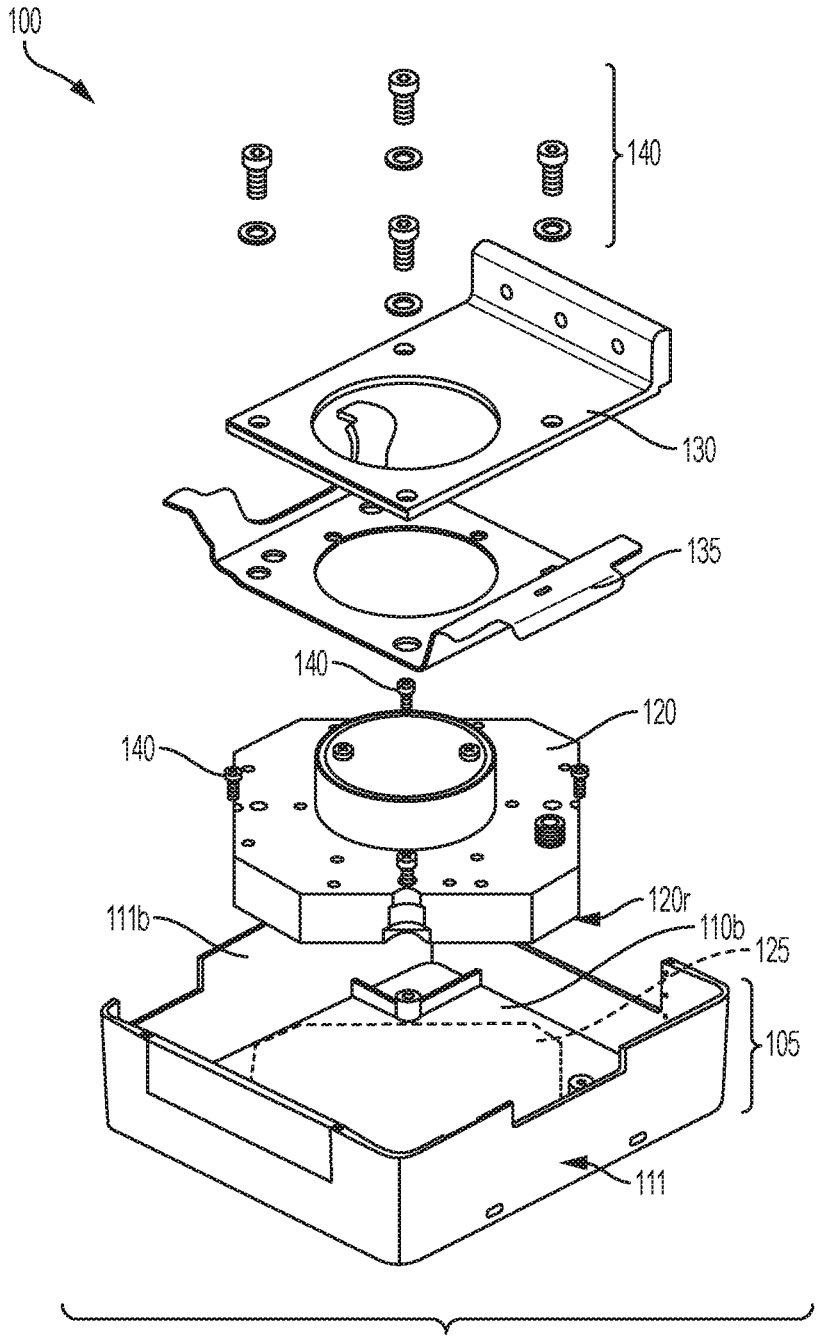
FIG. 1C is an exploded view of the interior of the flat panel antenna structure of FIG. 1B in accordance with some embodiments.

FIG. 1A is a perspective view of an exterior of a flat panel antenna structure in accordance with some embodiments. FIG. 1B is a perspective view of an interior of the flat panel antenna structure of FIG. 1A in accordance with some embodiments. FIG. 1C is an exploded view of the interior of the flat panel antenna structure of FIG. 1B in accordance with some embodiments.

Referring to FIGS. 1A-1C, the antenna structure 100 includes an antenna or radiator element 120 and a housing or enclosure 105 that protects the radiator element 120 from an operating environment. The radiator element 120 may include an array of elements characterized by array dimensions, such as a $2^N \times 2^M$ element array where N and M are integers. The radiator element 120 may be formed in multiple layers via machining or casting. For example, U.S. Pat. No. 8,558,746 to Thomson et al. (the disclosure of which is hereby incorporated by reference herein in its entirety) discusses a flat panel array antenna constructed as a series of different layers. Shown therein are flat panel arrays that include input, intermediate and output layers, with some embodiments including one or more slot layers and one or more additional intermediate layers. The layers are manufactured separately (typically via machining or casting) and stacked to form an overall feed network. Alternatively, the radiator element 120 may utilize a corporate waveguide network and cavity couplers provided in stacked layers, and an output layer including cavity output ports, polarization rotator elements, and horn radiators that are machined in a monolithic structure, as described for example in U.S. Provisional Patent Application No. 62/308,436 entitled "FLAT PANEL ARRAY ANTENNA WITH INTEGRATED POLARIZATION ROTATOR" to Biancotto et al., the disclosure of which is hereby incorporated by reference herein in its entirety.

As shown in greater detail in the exploded view of FIG. 1C, the radiator element 120 is secured to the enclosure 105 by various mounting hardware 140. The enclosure 105 and the mounting hardware 140 are designed or otherwise configured such that the radiator element 120 can be rotated within the enclosure 105 to adjust or alter a polarization thereof. For example, the radiator element 120 may be configured to be rotated by about 90 degrees within the enclosure 105 in some embodiments. An interface plate 135 is secured to the radiator element 120 opposite to the front face 110 of the enclosure 105 by the mounting hardware 140. The interface plate 135 includes various structures that are designed or otherwise configured to mechanically secure and/or electrically connect the radiator element 120 to external telecommunications equipment, such as a customer radio. A mounting plate 130 is secured to the interface plate 135 and the radiator element 120 by the mounting hardware 140. The mounting plate 130 is configured to attach the enclosure 105 to a mounting bracket, such as the bracket 320 shown in FIG. 3B.

As shown in FIGS. 1A-1C, the enclosure 105 includes a front face 110 that is positioned adjacent the radiating surface 120*r* of the radiator element 120, and sidewall surfaces 111 that house the radiator element 120 there between. The front face 110 includes an external or exterior surface 110*a* and an internal or interior surface 110*b*. In embodiments in which the enclosure has a varying or non-uniform thickness, the internal or interior surface may refer to the primary interior surface that defines the greatest thickness with respect to the opposite external or exterior surface. The sidewall surfaces 111 likewise include external or exterior surfaces 111*a* and internal or interior surfaces 111*b*, respectively.

In the example of FIGS. 1A-1C, the enclosure 105 is a single-part radome-enclosure in which a radome portion 125 (illustrated with a dashed line) and the enclosure 105 are defined by a unitary member of a same material. In particular, the radome 125 is integrated with the front face 110 of the enclosure 105 using injection-molding techniques. The radome 125, which is positioned on or adjacent the radiating surface 120*r* of the radiator element 120, may be thinner than surrounding portions or areas of the front face 110 that are adjacent the sidewall surfaces 111 in some embodiments. For example, an enclosure 105 including a thinner radome 125 (e.g., having a thickness of about 0.2 mm or less) than other portions of the front face 110 may allow for improved electrical performance as compared to a thicker radome 125 (e.g., having a thickness of about 1 mm) and/or an enclosure 105 where the radome 125 and the surrounding portions of the front face 110 have a same or uniform thickness (e.g., a thickness of about 4.5 mm). The thickness of the front face 110 may be defined between the external surface 110*a* and the internal surface 110*b* thereof, and may be stepped (as shown in FIGS. 4A-4E) or tapered (as shown in FIGS. 5A-5E) between the internal surface 110*b* and the external surface 110*a* in some embodiments. The use of a radome 125 that is thinner than the surrounding portions or areas of the front face 110 of the enclosure 105 allows the radiator element 120 to protrude beyond portions of the internal surface 110*b* of the front face 110 and be positioned closer to the external surface 110*a* of the front face 110. The radome portion 125 may also have a shape corresponding to the surface 120*r* of the radiator element 120, illustrated in FIGS. 1A-1C as a diamond-shape with beveled edges (thus defining an octagonal shape). However, it will be understood that radomes of other shapes, which may or may not correspond to the shape of the surface 120*r* of the radiator element 120, are also included in embodiments described herein. Also, while illustrated with reference to a particular orientation where the thinner radome portion 125 is rotated by about 45 degrees relative to the enclosure 105, it will be understood that other relative orientations between the radome 125 and the enclosure 105 (e.g., 20 degrees, 30 degrees, etc.) are included in embodiments described herein.

Some performance characteristics of a single-part radome-enclosure antenna structure as illustrated in FIGS. 1A-1C are illustrated in the graphs of FIGS. 7A-7D and 8A-8D over a ±180 degree azimuth angle range. In particular, FIGS. 7A-7D illustrate performance of the antenna structure 100 having a front face 110 including a 1.1 millimeter (mm) thick radome 125, while FIGS. 8A-8D illustrate performance of the antenna structure 100 having a front face 110 including a 0.24 millimeter (mm) thick radome 125, relative to desired envelopes e217v121R5C3B and e217v121R5C4. The e217v121R5C3B and e217v121R5C4 envelopes are ETSI Radiation Pattern Envelopes (RPEs), which the antenna radiation patterns should fall within or not cross in order to homologate the antenna as "ETSI Class 3" and "ETSI Class 4," respectively. The higher the Class, the more directive (and less prone to interference) the antenna.

Figure 7A:
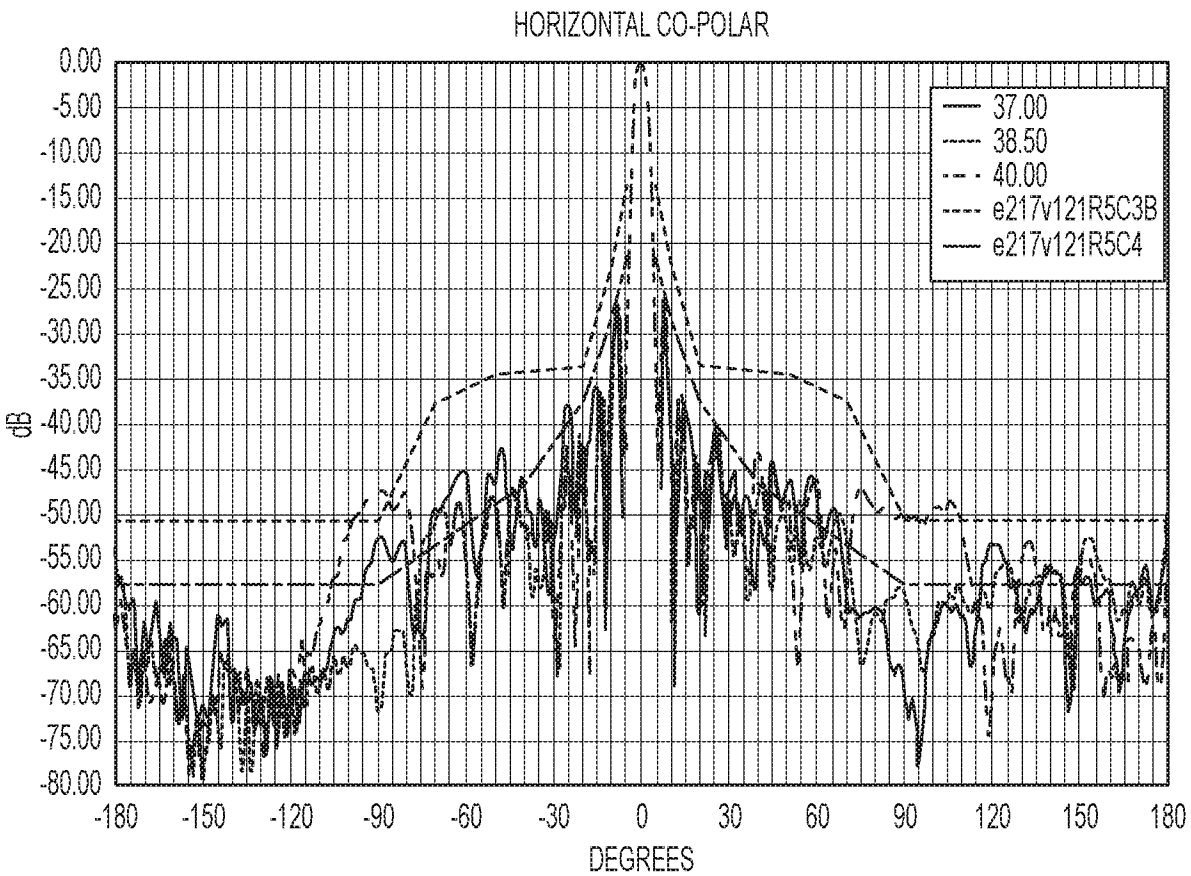
FIGS. 7A-7D are graphs illustrating performance of a flat panel antenna structure having a front face including a 1.1 millimeter (mm) thick radome in accordance with some embodiments.
Figure 7B:
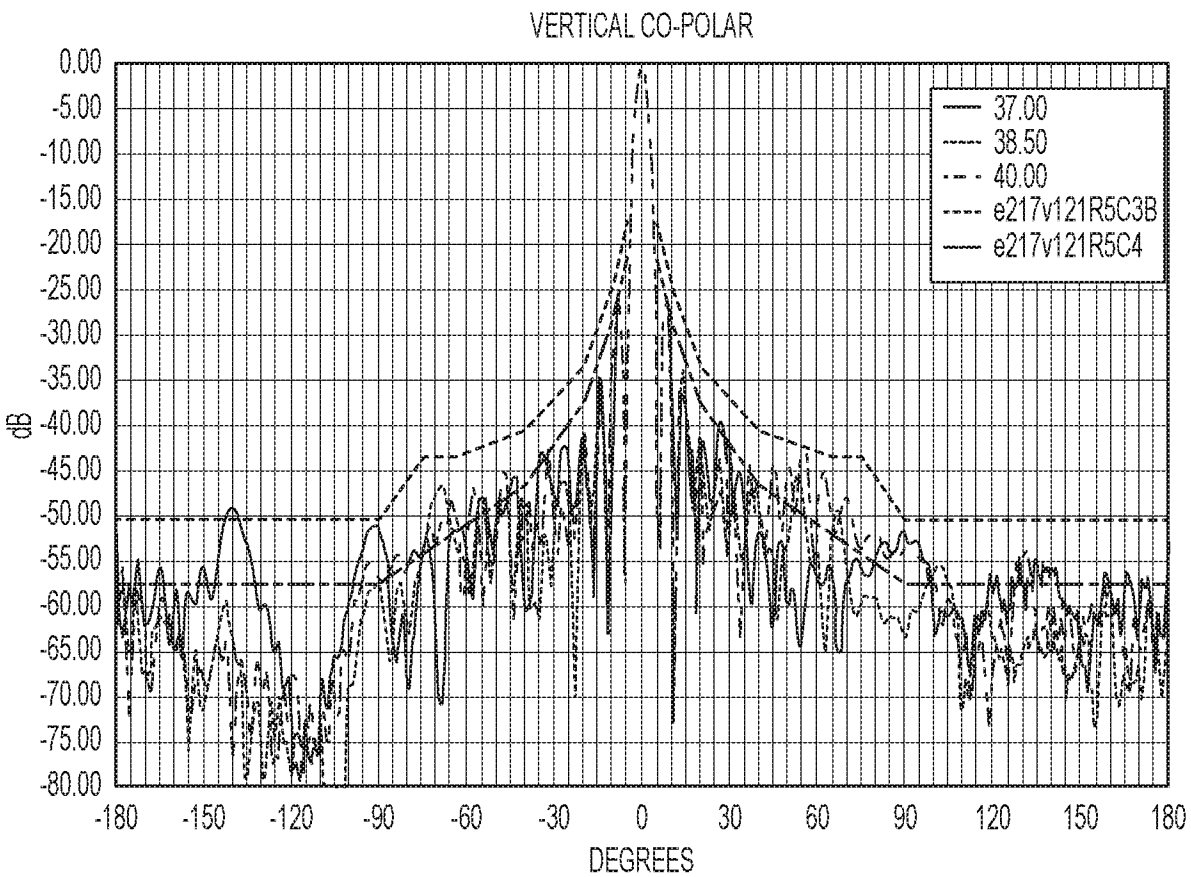
Figure 7C:
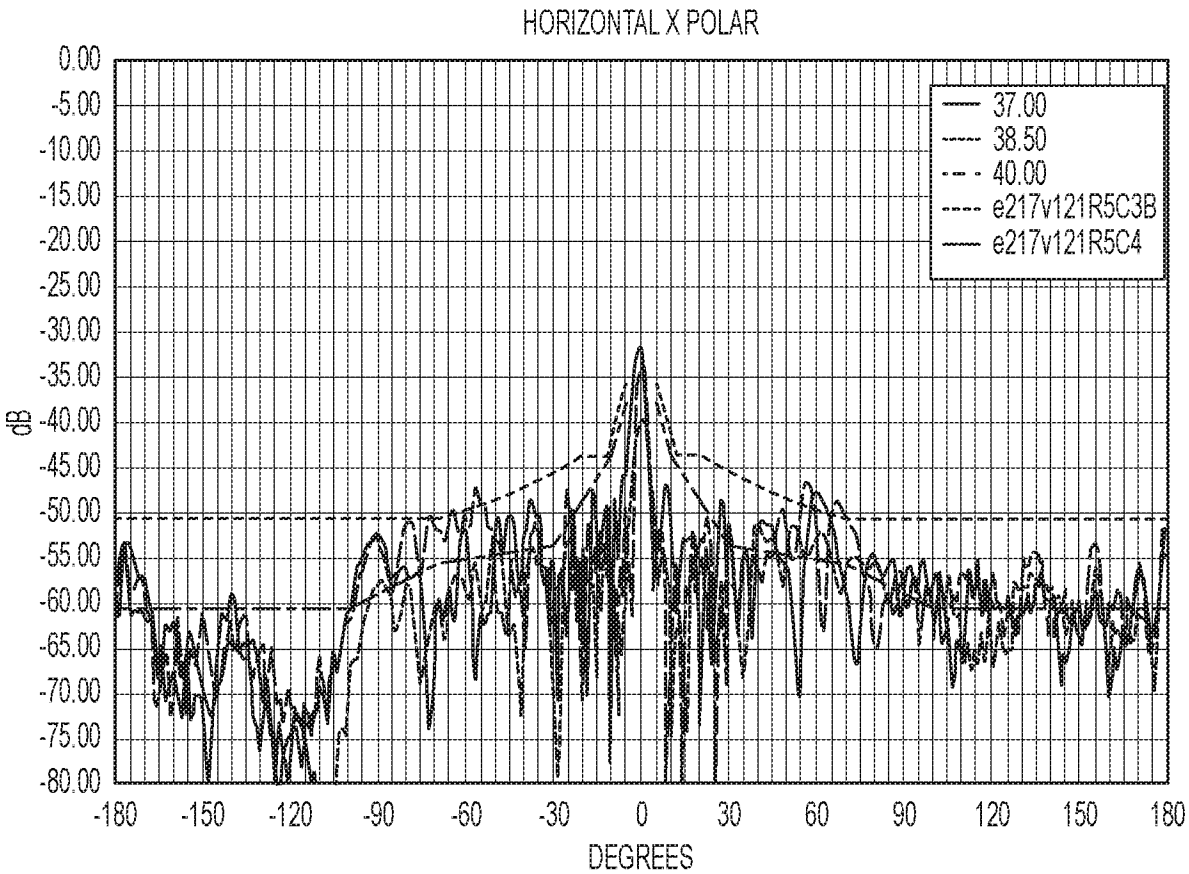
Figure 7D:
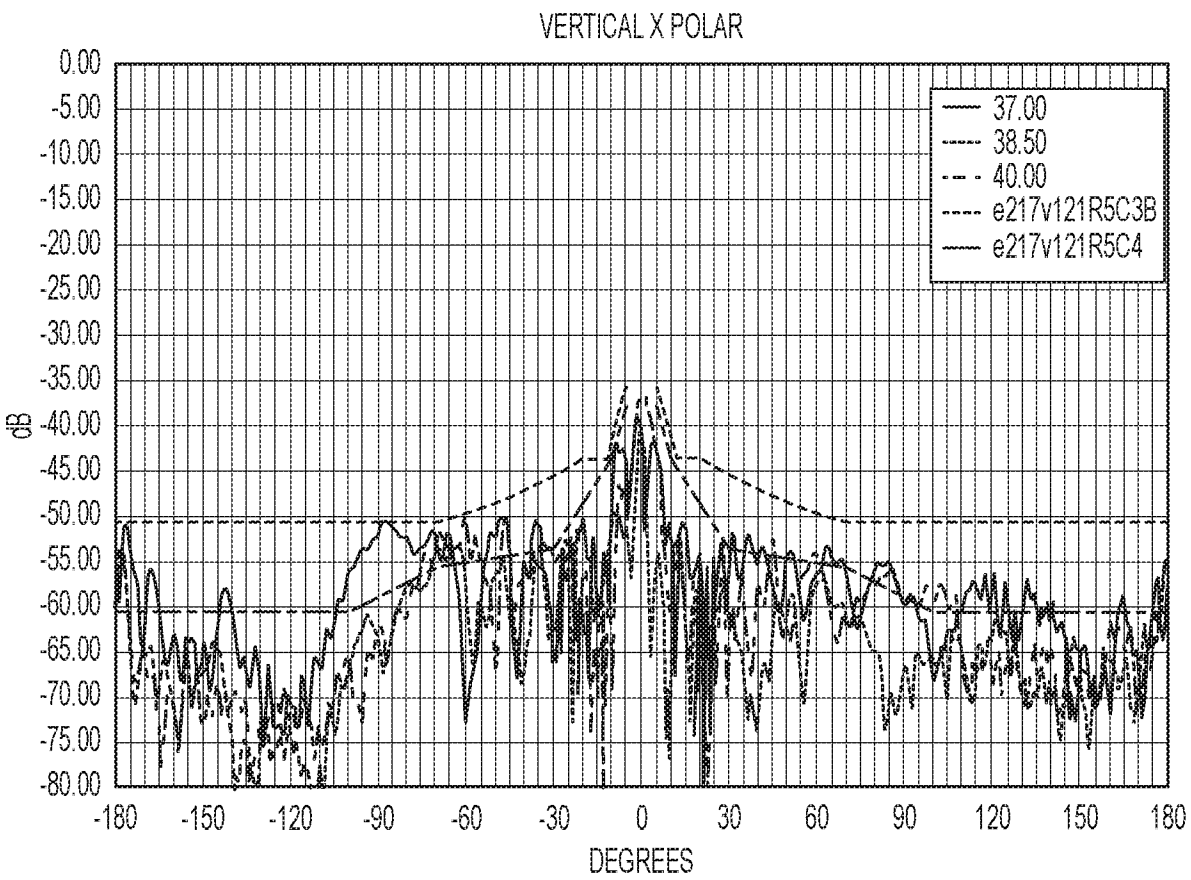
Figure 8A:
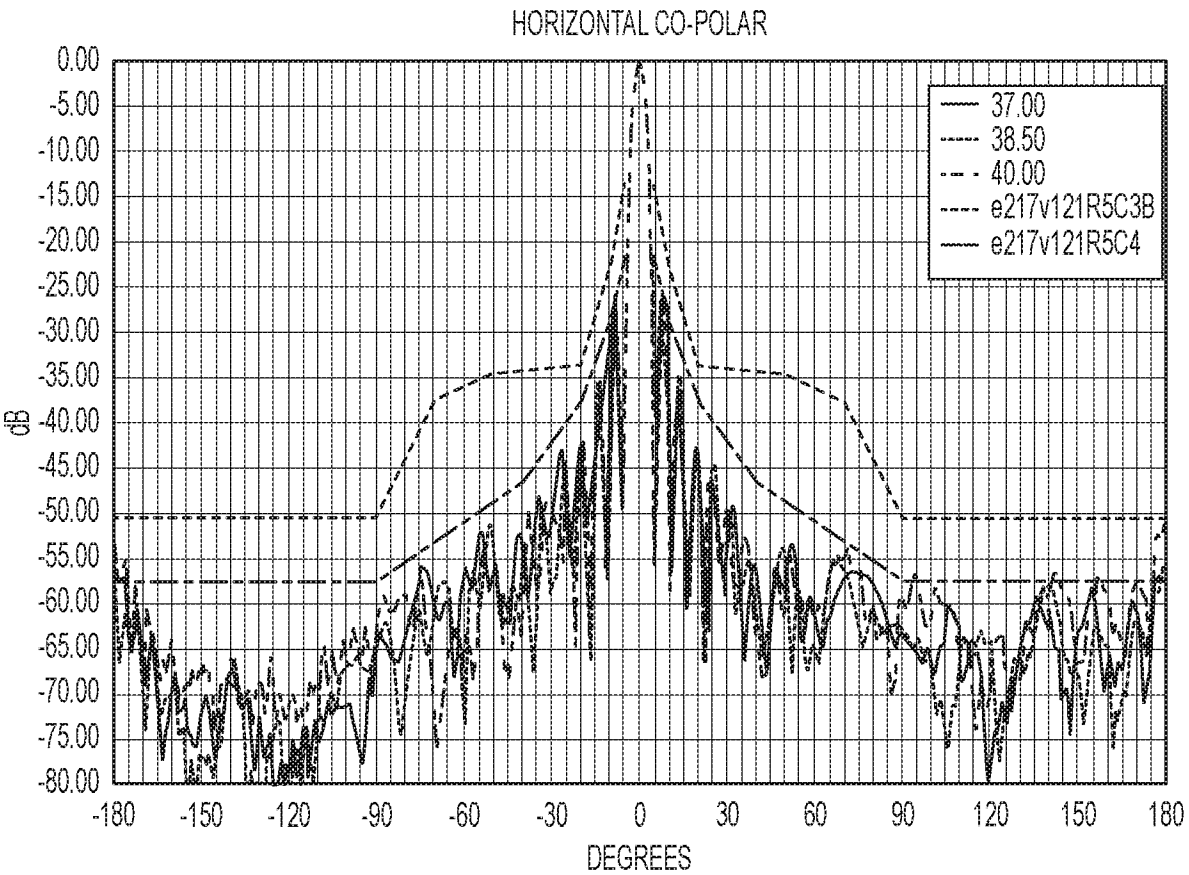
FIGS. 8A-8D are graphs illustrating performance of a flat panel antenna structure having a front face including a 0.24 millimeter (mm) thick radome in accordance with some embodiments.
Figure 8B:
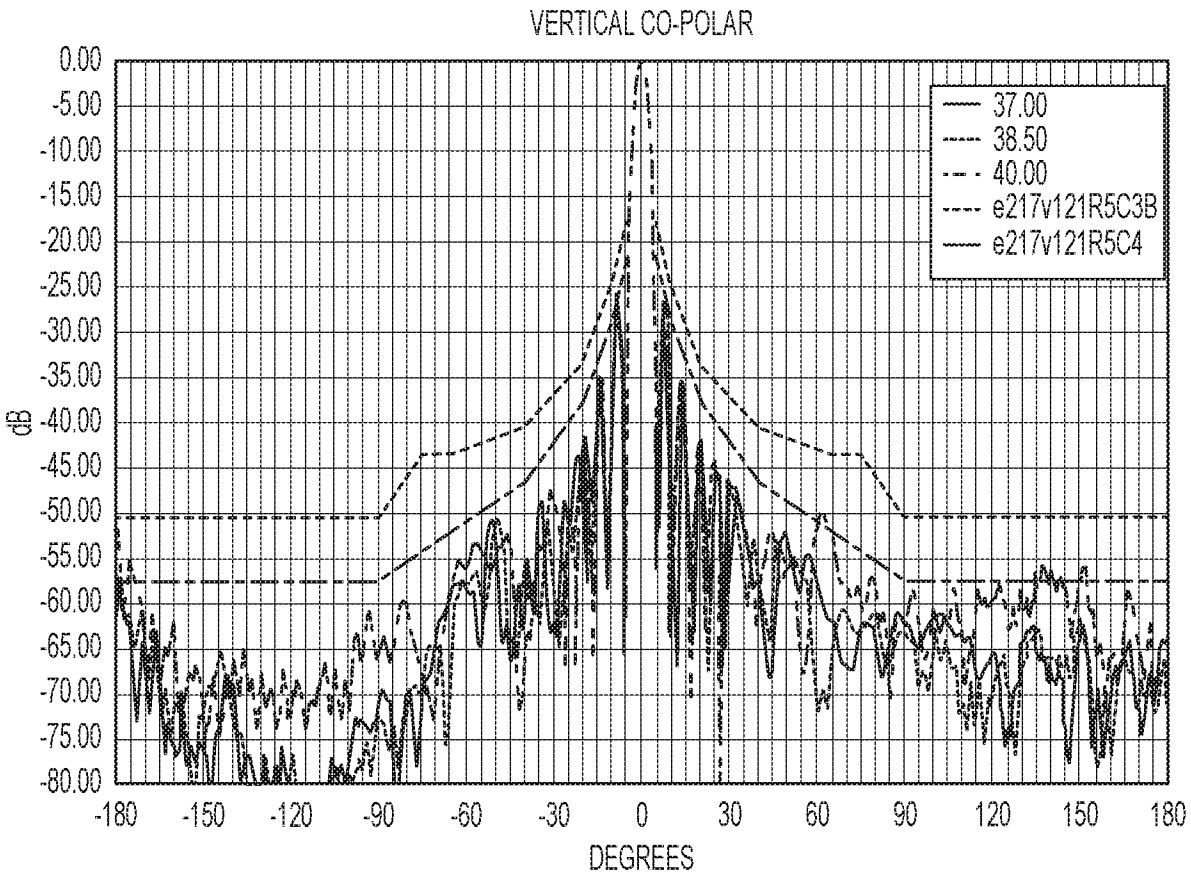
Figure 8C:
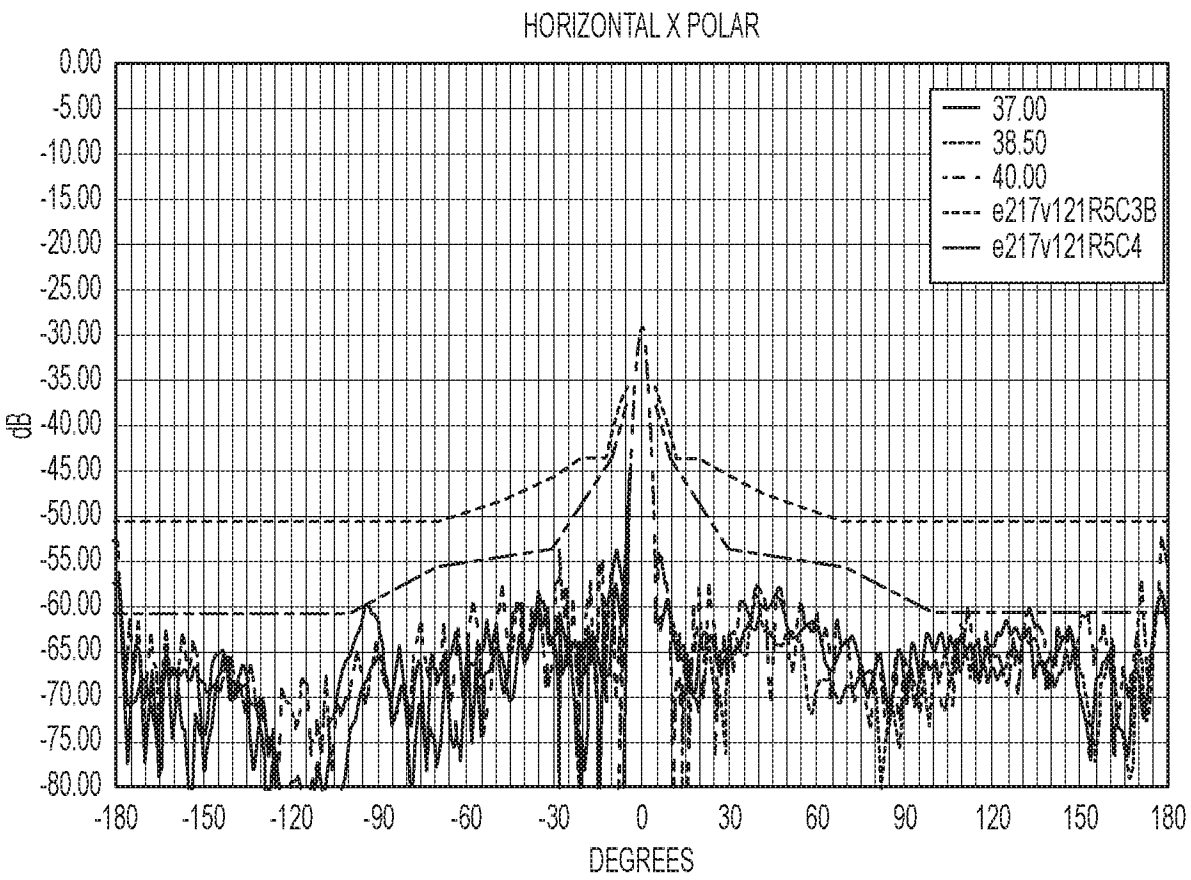
Figure 8D:
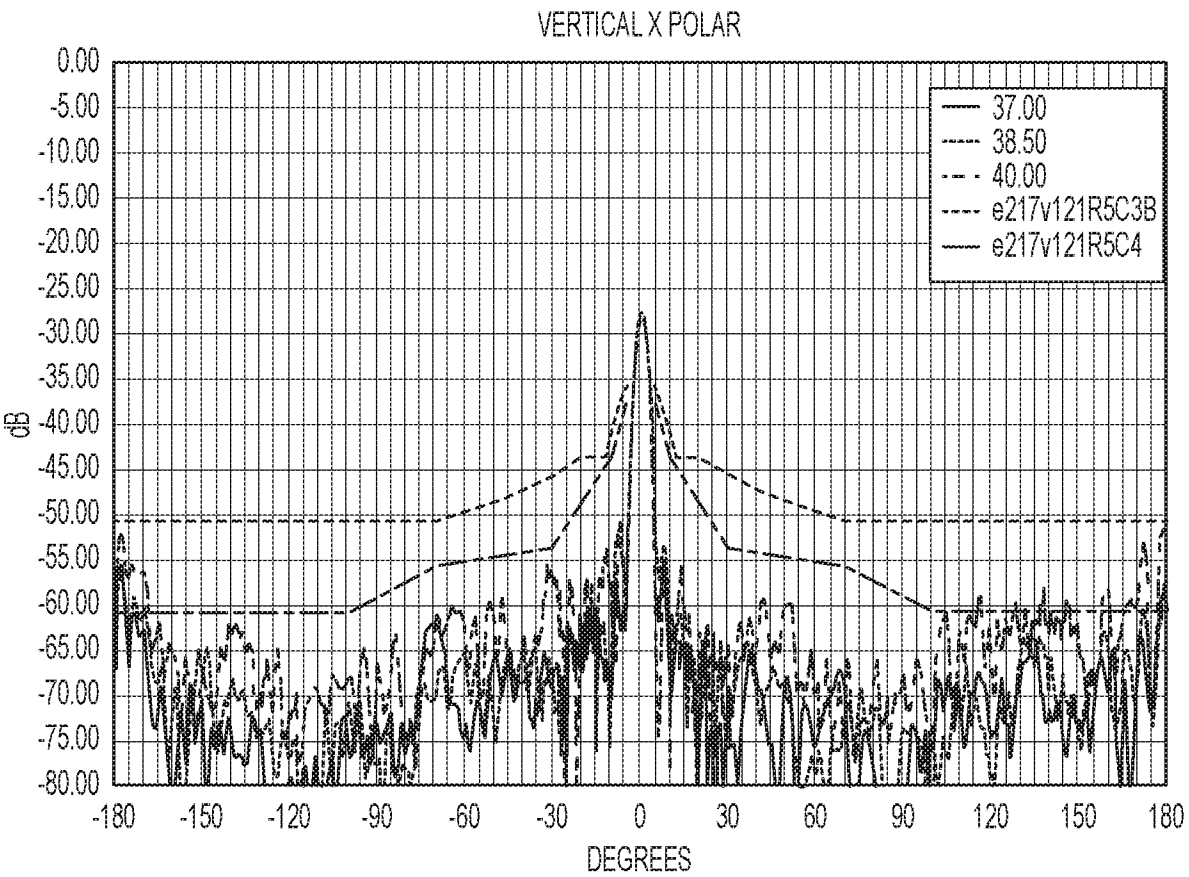

As shown in FIGS. 7A, 7B, 8A, and 8B, both horizontal and vertical co-polarization characteristics (for the desired polarization states of the radiation pattern) are improved in the embodiments of FIGS. 8A and 8B as compared to the embodiments of FIGS. 7A and 7B, respectively. The radiation pattern improvement is given by 37.00, 38.50 and 40.00 measurements being suppressed below the e217v121R5C3B specification. Likewise, as shown in FIGS. 7C, 7D, 8C, and 8D, horizontal and vertical cross-polarization characteristics (for the polarization states orthogonal to the desired polarization states of the radiation pattern) are improved in the embodiments of FIGS. 8C and 8D as compared to the embodiments of FIGS. 7C and 7D, respectively. FIGS. 7A-7D and 8A-8D thus illustrate that performance of the radiator element 120 may be improved by reducing the thickness of the radome 125, thereby allowing the radiating surface 120*r* of the radiator element 120 to be positioned as close as possible to the external surface 110*a* of the enclosure 105 while still providing sufficient protection from conditions of the operating environment.

Figure 2A:
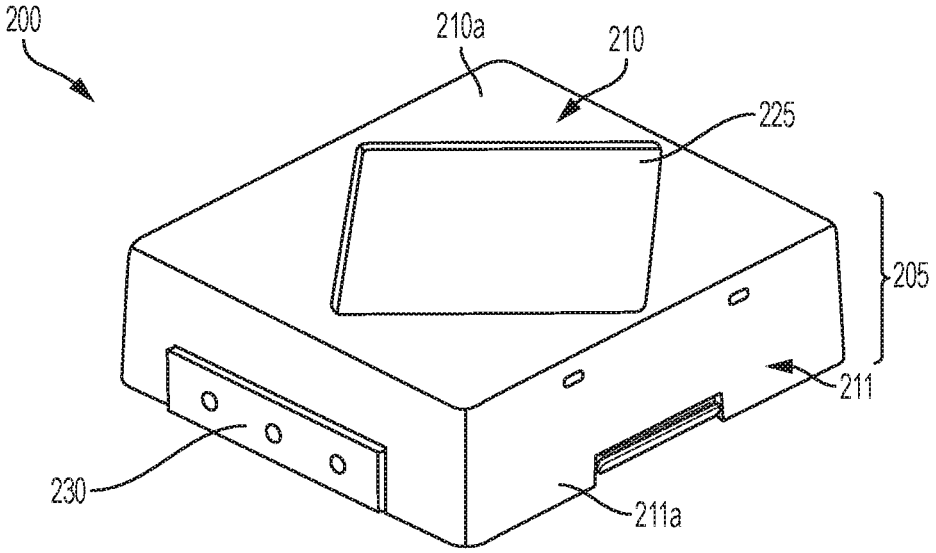
FIG. 2A is a perspective view of an exterior front face of a flat panel antenna structure in accordance with some embodiments.
Figure 2B:
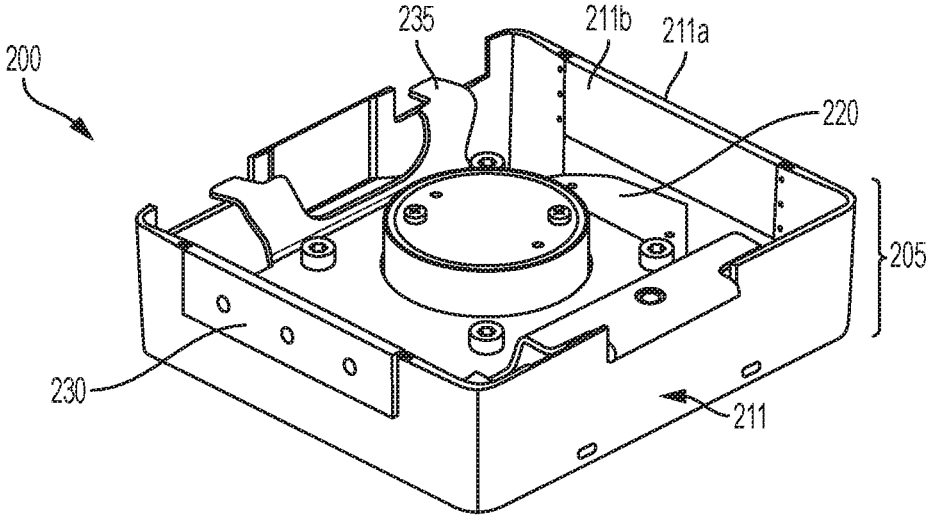
FIG. 2B is a perspective view of an interior of the flat panel antenna structure of FIG. 2A in accordance with some embodiments.
Figure 2C:
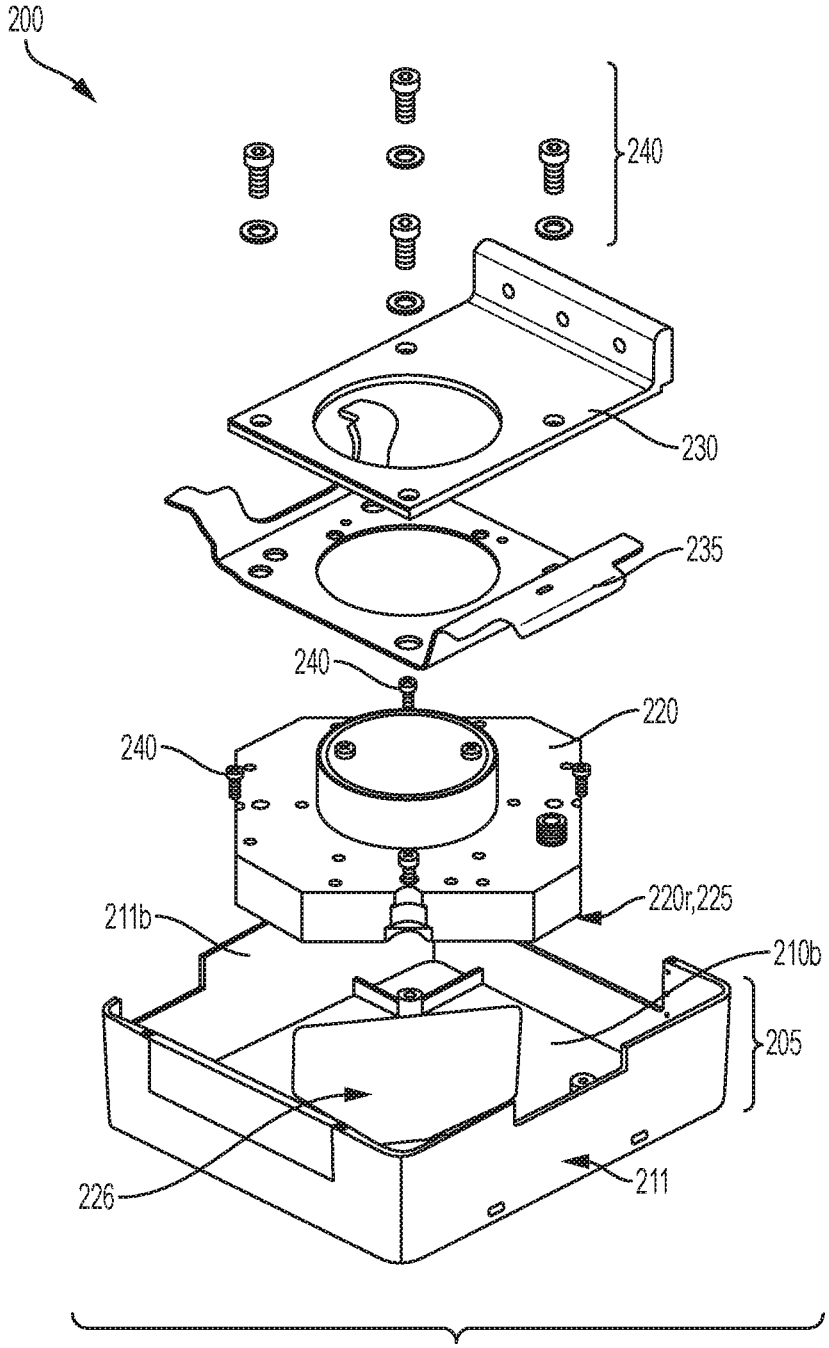
FIG. 2C is an exploded view of the interior of the flat panel antenna structure of FIG. 2B in accordance with some embodiments.

FIG. 2A is a perspective view of an exterior of a flat panel antenna structure in accordance with some embodiments. FIG. 2B is a perspective view of an interior of the flat panel antenna structure of FIG. 2A in accordance with some embodiments. FIG. 2C is an exploded view of the interior of the flat panel antenna structure of FIG. 2B in accordance with some embodiments.

Referring to FIGS. 2A-2C, the antenna structure 200 includes an antenna or radiator element 220 and housing or enclosure 205 that protects the radiator element 220 from an operating environment. The radiator element 220 may include monolithic and/or multiple layers that are formed via machining or casting. As shown in greater detail in the exploded view of FIG. 2C, the radiator element 220 is secured to the enclosure 205 by various mounting hardware 240. The enclosure 205 and the mounting hardware 240 are designed or otherwise configured such that the radiator element 220 can be rotated within the enclosure 205 to adjust or alter a polarization thereof. For example, the radiator element 220 may be configured to be rotated by about 90 degrees within the enclosure 205 in some embodiments. An interface plate 235 is secured to the radiator element 220 opposite to the front face 210 of the enclosure 205 by the mounting hardware 240. The interface plate 235 includes various structures that are designed or otherwise configured to mechanically secure and/or electrically connect the radiator element 220 to external telecommunications equipment, such as a customer radio. A mounting plate 230 is secured to the interface plate 235 and the radiator element 220 by the mounting hardware 240. The mounting plate 230 is configured to attach the enclosure 205 to a mounting bracket, such as the bracket 320 shown in FIG. 3B.

As shown in FIGS. 2A-2C, the enclosure 205 includes a front face 210 that is positioned adjacent the radiating surface 220*r* of the radiator element 220, and sidewall surfaces 211 that house the radiator element 220 there between. The front face 210 includes an external or exterior surface 210*a* and an internal or interior surface 210*b*. In embodiments in which the enclosure has a varying or non-uniform thickness, the internal or interior surface may refer to the primary interior surface having the greatest thickness with respect to the opposite external or exterior surface. The sidewall surfaces 211 likewise include external or exterior surfaces 211*a* and internal or interior surfaces 211*b*, respectively.

In the example of FIGS. 2A-2C, the enclosure 205 is a two-part radome-enclosure including a radome 225 that is a separate or distinct component from the enclosure 205. In particular, the radome 225 is a thin layer or film that is attached to the radiating surface 220*r* of the radiator element 220. The enclosure 205 includes an opening 226 between the interior surface 210*b* and the exterior surface 210*a* of the front face 210. The opening 226 is sized and shaped to expose at least a portion of the surface 220*r* of the radiator element 220 that includes the radome 225 thereon. For example, one or more dimensions of the opening 226 in the enclosure 205 may be smaller than one or more dimensions of the surface 220*r* of the radiator element 220, such that the radome 225 thereon is recessed relative to the external surface 210*a* of the front face 210 of the enclosure 205. However, it will be understood that the opening 226 may have the same or larger dimensions than the surface 220*r* of the radiator element, and thus, in some embodiments, the radome 225 may be coplanar with or protrude from the external surface 210*a* of the front face 210 of the enclosure.

The thickness of the radome 225 is less than a thickness of the front face 210 of the enclosure, as defined between the external surface 210*a* and the internal surface 210*b* thereof. The use of a thinner radome 225 (e.g., about 0.1-0.5 mm) for environmental protection of the radiator element 220 can reduce or avoid disruption of the electrical performance of the radiator element 220, while the thicker enclosure 205 (e.g., about 4.5 mm or more) can provide sufficient structural strength and/or rigidity to support the radiating element 220 and/or other components housed within the enclosure 205. The radome thickness may vary according to frequency of operation of the radiator element 220. The radome 225 and the enclosure 205 may be formed of the same or different materials, by the same or different processes. For example, in some embodiments, the radome 225 and the enclosure 205 may be formed of a plastic material; however, the radome 225 may be formed via an extrusion process, while the enclosure 205 may be formed via an injection molding process. In other embodiments, the radome 225 may be formed of a flexible material, such as an ultraviolet (UV)-stable polymer, while the enclosure 205 may be formed from a rigid material. The radome 225 may be attached to the radiating surface 220*r* of the radiator element 220 using glue or tape in some embodiments. The radiator element 220 may thus be secured to the enclosure 205 using the mounting hardware 240, such that the radome 225 itself is not physically attached to the front face 210 of enclosure 205.

The thickness of the front face 210 may be defined between the external surface 210*a* and the internal surface 210*b* thereof, and may be stepped (as shown in FIGS. 4A-4E) or tapered (as shown in FIGS. 5A-5E) between the internal surface 210*b* and the external surface 210*a* in some embodiments to further improve performance. For example, portions of the front face 210 adjacent the sidewall surfaces 211 may have a greater thickness (e.g., a thickness of about 4.5 mm or more), and a portion of the front face 210 surrounding the opening 226 or bordering and/or overlapping the surface 220*r* of the radiator element may be stepped or tapered to a reduced thickness (e.g., a thickness of about 1.5 mm or less). The radome 225 is likewise thinner than the portions of the front face 210 surrounding the opening 226. Embodiments in which the front face 210 includes portions of different thicknesses allows the radiator element 220 (including the radome 225 attached to the surface 220*r* thereof) to protrude beyond the internal surface 210*b* of the enclosure and be positioned closer to the external surface 210*a* of the front face 210, thereby improving radiation performance.

The opening 226 and/or radome 225 may also have a shape similar or corresponding to the surface 220*r* of the radiator element 220. For example, as illustrated in FIGS. 2A-2C, the opening 226 exposing the radome 225 has a diamond-shape with rounded edges, while the surface 220*r* of the radiator element 220 has a diamond-shape with beveled edges. However, it will be understood that radomes and/or openings 226 of other shapes, which may or may not correspond to the shape of the surface 220*r* of the radiator element 220, are also included in embodiments described herein. Also, while illustrated with reference to a particular orientation where the opening 226 and/or radome 225 are rotated by about 45 degrees relative to the enclosure 205, it will be understood that other relative orientations between the opening 226/radome 225 and the enclosure 205 (e.g., 20 degrees, 30 degrees, etc.) are included in embodiments described herein.

Figure 3A:
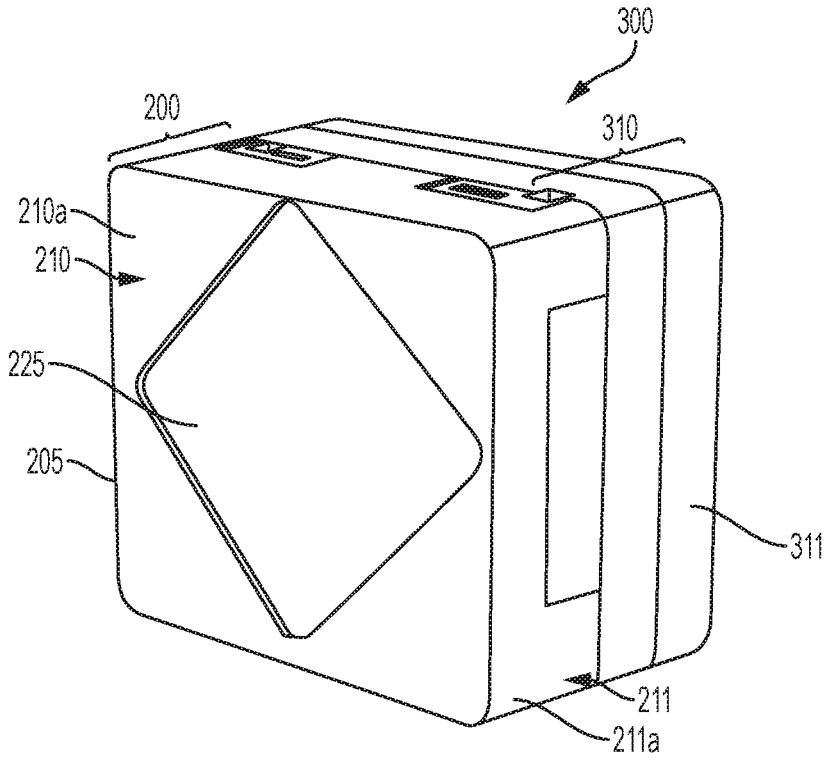
FIG. 3A is a perspective view of a telecommunications device including the flat panel antenna structure of FIG. 2A as attached to a user or customer equipment.
Figure 3B:
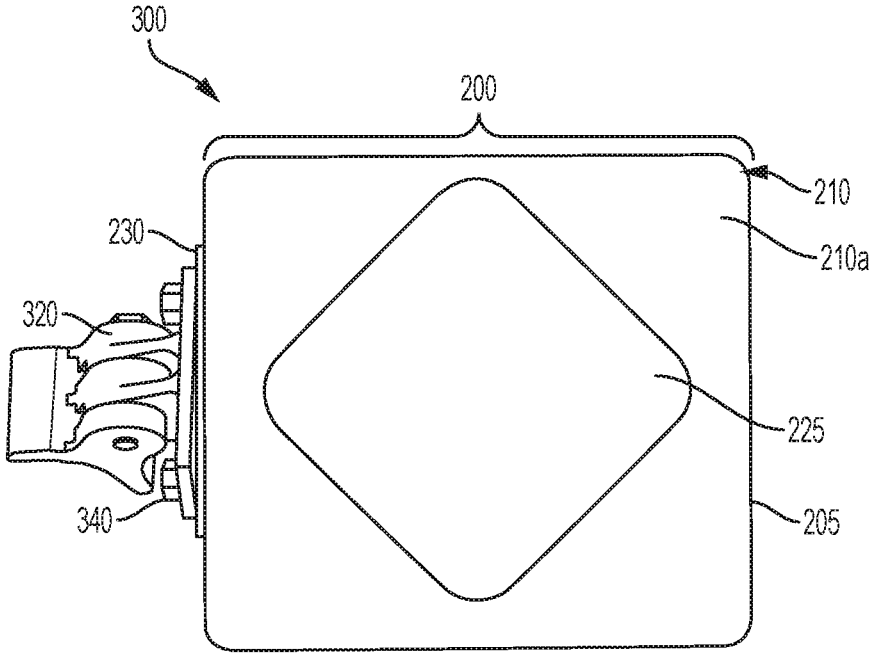
FIG. 3B is a front view of the telecommunications device including the flat panel antenna structure of FIG. 3A as attached to a mounting bracket.

FIG. 3A is a perspective view of a telecommunications device including the flat panel antenna structure of FIG. 2A attached to a user or customer equipment, while FIG. 3B is a front view of the telecommunications device including the flat panel antenna structure of FIG. 3A as attached to a mounting bracket. As shown in FIGS. 3A and 3B, the telecommunications device 300 includes the antenna structure 200, which is a two-part design including an enclosure 205 having a front face 210 and a radome 225 that is recessed relative to the external surface 210*a* of the front face 210. However, as mentioned above, the radome 225 may be coplanar with or protruding from the external surface 210*a* of the front face 210 in some embodiments.

FIG. 3A further illustrates attachment of the antenna structure 200 to customer equipment, illustrated as a customer radio 310. As shown in FIG. 3A, the enclosure 205 is designed or otherwise configured such that the sidewalls 211 thereof are aligned with corresponding sidewalls 311 of the customer radio 310. The color and/or other aesthetic aspects of the enclosure 205 may also be matched to those of the customer radio 310. In addition, the enclosure 205 is configured to mate with or is otherwise mechanically compatible with attachment points on the customer radio 310. In particular, the attachment points of the interface plate 235 shown in the exploded view of FIG. 2C are sized and configured to align with corresponding attachment points on the customer radio 310, such that the antenna structure 200 can be secured to the customer radio 310 by the mounting hardware 240. The radiator element 220 within the enclosure 205 is likewise configured for electrical connection to one or more components of the customer radio 310. More generally, the physical, electrical, and/or aesthetic design of the antenna structure 200 and enclosure 205 may match or closely correspond to that of the customer radio 310.

FIG. 3B further illustrates attachment of the telecommunications device 300 to a mounting bracket 320. In particular, the enclosure 205 is attached to the mounting bracket 320 via attachment points on the mounting plate 230 shown in the exploded view of FIG. 2C. The attachment points on the mounting plate 230 are sized and configured to align with corresponding attachment points on the mounting bracket 320, such that the antenna structure 200 can be secured to the mounting bracket 320 by mounting hardware 340. While illustrated in FIG. 3B with reference to attachment of the enclosure 205 to the mounting bracket 320 by way of example, it will be understood that additional and/or alternative attachments to the mounting bracket 320 may be provided. For example, in some embodiments, the attachment of the telecommunications device 300 to the mounting bracket 320 may be implemented by attachment points on the customer radio 310, rather than or in addition to those of the mounting plate 230 of the antenna structure 200.

Figure 4A:
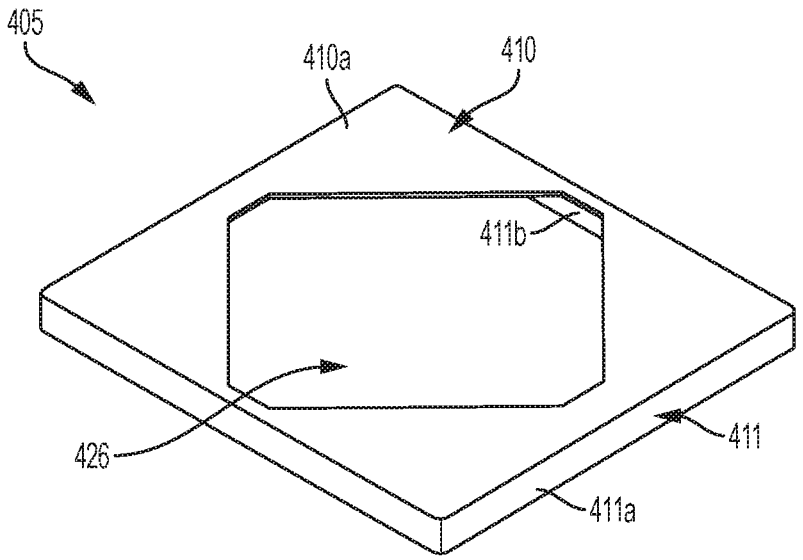
FIG. 4A is a perspective view of an exterior of the front face of a flat panel antenna enclosure in accordance with some embodiments.
Figure 4B:
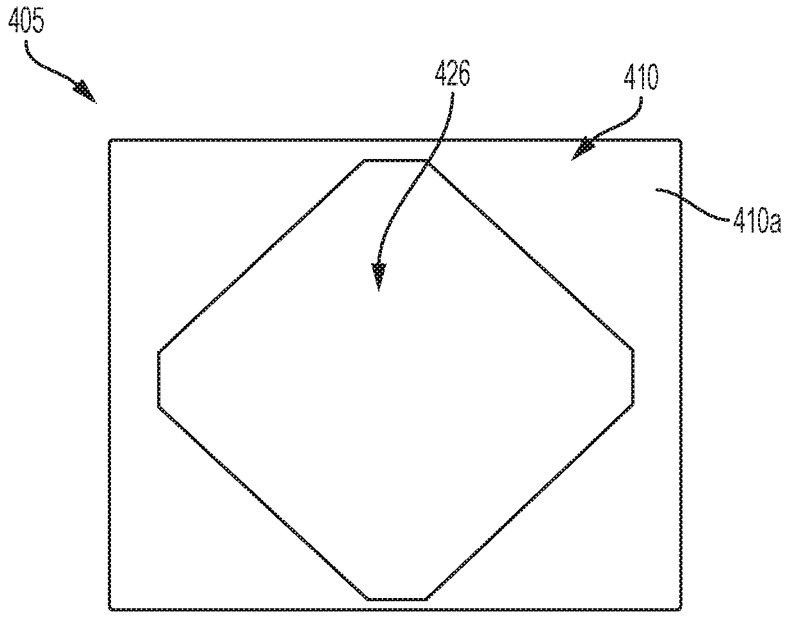
FIG. 4B is a front view of an exterior of the front face of the flat panel antenna enclosure of FIG. 4A in accordance with some embodiments.

FIGS. 4A-4E are various views illustrating the front face of a flat panel antenna enclosure in accordance with some embodiments. In particular, as shown in the external perspective view of FIG. 4A, the front face 410 of the enclosure 405 includes an exterior or external surface 410*a* that is bounded by outer surfaces 411*a* of sidewalls 411. The front face 410 includes an opening 426 extending there through from the external surface 410*a* to the internal surface 410*b*. The opening 426 has a shape corresponding to the shape of an antenna or radiator element to be housed in the enclosure 405. In the embodiments of FIGS. 4A-4E, the opening 426 is shaped according to the shape of the radiator element 120 of FIGS. 1A-1C; however, it will be understood that the opening 426 may be shaped differently from that of the radiator element to be housed therein in some embodiments. FIG. 4B further illustrates the shape of the opening 426 in front view. As shown in FIG. 4B, the opening 426 may not be centered on the front face 410 of the enclosure 405, but rather, may be shifted toward one or more of the sidewall surfaces 411.

Figure 4C:
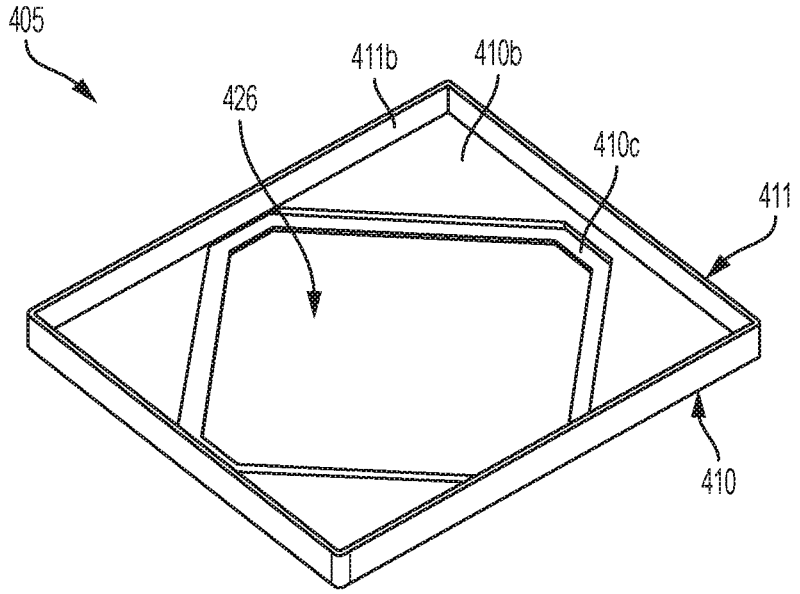
FIG. 4C is a perspective view of an interior of the front face of the flat panel antenna enclosure of FIG. 4A in accordance with some embodiments.
Figure 4D:
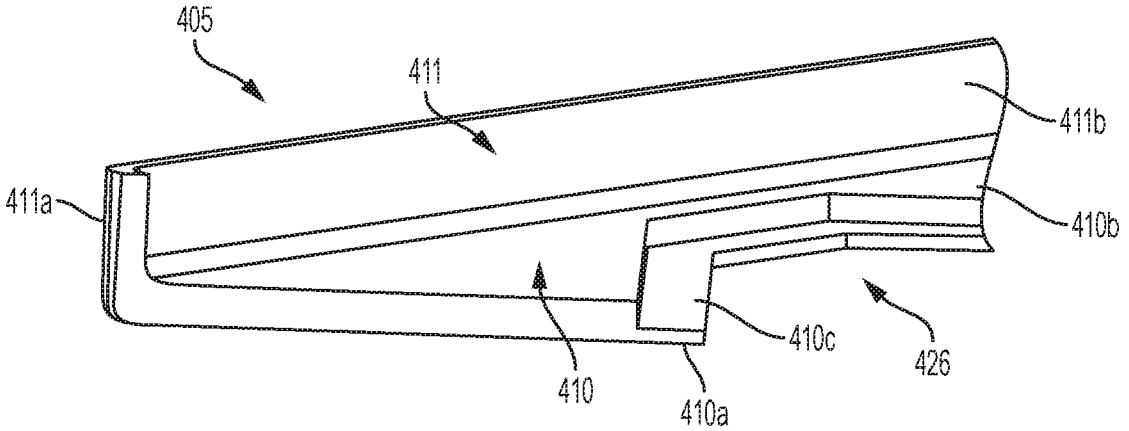
FIG. 4D is an enlarged view of an interface between sidewall surfaces and an internal surface of the interior of the front face of the flat panel antenna enclosure of FIG. 4C.

FIG. 4C and FIG. 4D (which is an enlarged view of an edge portion of FIG. 4C) illustrate the interior of the enclosure 405, and in particular, the internal surface 410*b* that is opposite to the external surface 410*a* illustrated in FIGS. 4A and 4B. As shown in FIGS. 4C and 4D, the inner or internal surface 410*b* of the front face 410 is bounded by inner surfaces 411*b* of the sidewalls 411. The opening 426 in the front face 410 extends from the external surface 410*a* to the internal surface 410*b*. A thickness of the front face 410 (as defined between the external surface 410*a* and the internal surface 410*b*) may be non-uniform in some embodiments. In particular, as a uniformly thick front face 410 of the enclosure 405 may negatively affect performance (e.g., radiation patterns) of a radiator element that is positioned adjacent the front face 410 within the enclosure 405, embodiments described herein provide a front face 410 having a greater thickness T1 between the external surface 410*a* and the internal surface portion 410*b* adjacent the sidewall surfaces 411, and a lesser thickness T2 between the external surface 410*a* and an internal surface portion 410*c* adjacent or surrounding the opening 426, as shown in greater detail in the cross-sectional view of FIG. 4E.

Figure 4E:
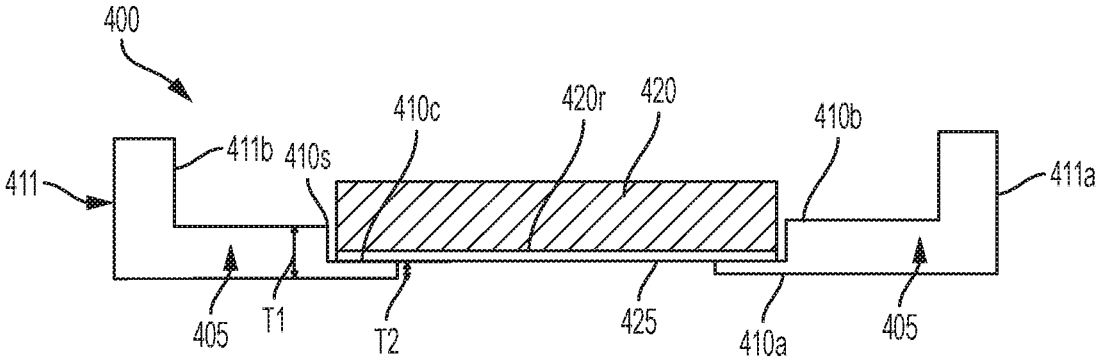
FIG. 4E is a cross-sectional view of the front face of the flat panel antenna structure of FIG. 4A including a radiator element therein in accordance with some embodiments.

Referring to FIG. 4E, the antenna structure 400 includes an antenna or radiator element 420 that is housed within the sidewall surfaces 411 and adjacent the front face 410 of the enclosure 405. A protective radome 425 is attached or otherwise provided on a radiating surface 420*r* of the radiator element 420. The opening 426 in the front face 410 is sized to expose the surface 420*r* of the radiator element 420 that includes the radome 425 thereon. In the example of FIG. 4E, the dimensions of the opening 426 are smaller than the dimensions of the surface 420*r* of the radiator element 420, such that a portion 410*c* of the internal surface 410*b* of the front face 410 overlaps with edges of the radome 425, defining a border around the perimeter of the radiating surface 420*r* of the radiator element 420. As such, the surface 420*r* of the radiator element 420 including the radome 425 thereon is recessed relative to the external surface 410*a* of the front face 410 of the enclosure 405. However, it will be understood that in some embodiments the opening 426 may have the same or larger dimensions than the surface 420*r* of the radiator element 420, and thus, the radome 425 may be coplanar with or protrude beyond the external surface 410*a* of the front face 410 of the enclosure 405.

As shown in FIGS. 4C-4E, the front face 410 of the enclosure 405 thus includes areas having a non-uniform or varying thickness, where a thickness T1 (between the external surface 410*a* and the internal surface 410*b* adjacent the sidewall surfaces 411) differs from a thickness T2 (between the external surface 410*a* and the internal surface 410*c* adjacent or surrounding the opening 426). For example, the thickness T1 of the front face 410 adjacent the sidewall surfaces 411 may be about 4.5 mm or more to provide the enclosure 405 with sufficient structural rigidity to provide environmental protection of the radiator element 420, while the thickness T2 of the front face 410 adjacent the opening 426 may be about 1.5 mm or less to allow for sufficient radiative performance of the radiator element 420. A stepped portion 410*s* is thereby defined at an interface between the internal surface 410*b* and the internal surface 410*c* over the thickness of the front face 410 of the enclosure, due to the differing thicknesses T1 and T2. This step difference 410*s* allows the radiating surface 420*r* of the radiator element 420 to be positioned closer to the external surface 410*a* of the front face 410 of the enclosure, which may improve radiative performance.

The radome 425 on the radiating surface 420*r* of the radiator element 420 may have a thickness that is less than the thickness T2. For example, the radome 425 may be an extruded plastic thin film, while the enclosure 405 may be injection-molded plastic. The radome 425 and the enclosure 405 may be formed of different materials in some embodiments. Also, the amount of overlap between the internal surface 410*c* and the perimeter of the radiating surface 420*r* is shown for purposes of illustration only, and may be reduced or increased to provide improved or optimal performance of the radiator element 420.

Figure 5A:
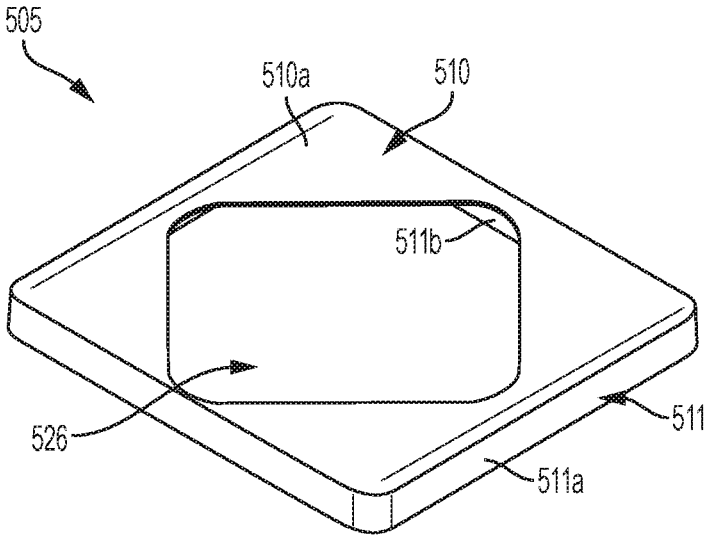
FIG. 5A is a perspective view of an exterior of the front face of a flat panel antenna enclosure in accordance with some embodiments.
Figure 5B:
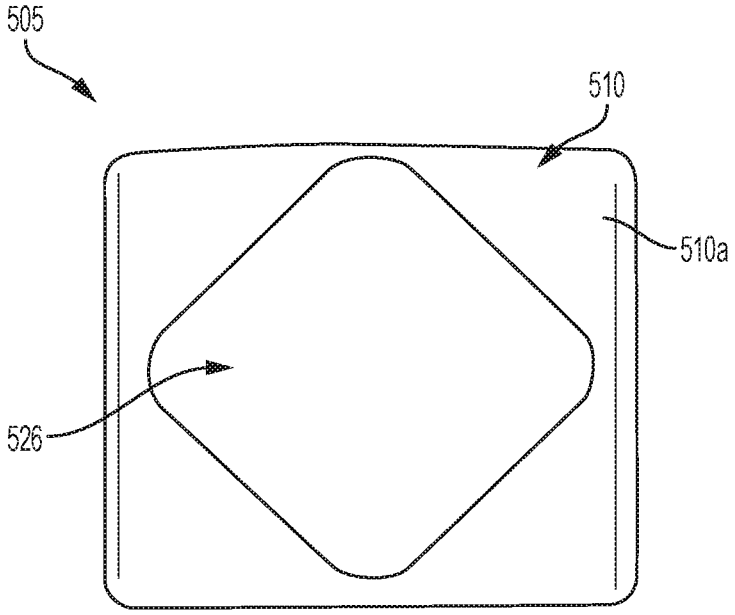
FIG. 5B is a front view of an exterior of the front face of the flat panel antenna enclosure of FIG. 5A in accordance with some embodiments.

FIGS. 5A-5E are various views illustrating the front face of a flat panel antenna enclosure in accordance with some embodiments, such as those shown in FIGS. 2A-2C and 3A-3B. In particular, as shown in the external perspective view of FIG. 5A, the front face 510 of the enclosure 505 includes an exterior or external surface 510*a* that is bounded by outer surfaces 511*a* of sidewalls 511. The front face 510 includes a diamond-shaped opening 526 extending there through from the external surface 510*a* to the internal surface 510*b*. The opening 526 may have a shape corresponding or similar to the shape of an antenna or radiator element to be housed in the enclosure 505; however, it will be understood the opening 526 may also be shaped differently from that of the radiator element to be housed therein. FIG. 5B further illustrates the shape of the opening 526 in front view. As shown in FIG. 5B, the opening 526 may not be centered on the front face 510 of the enclosure 505, but may be shifted toward one or more of the sidewall surfaces 511.

Figure 5C:
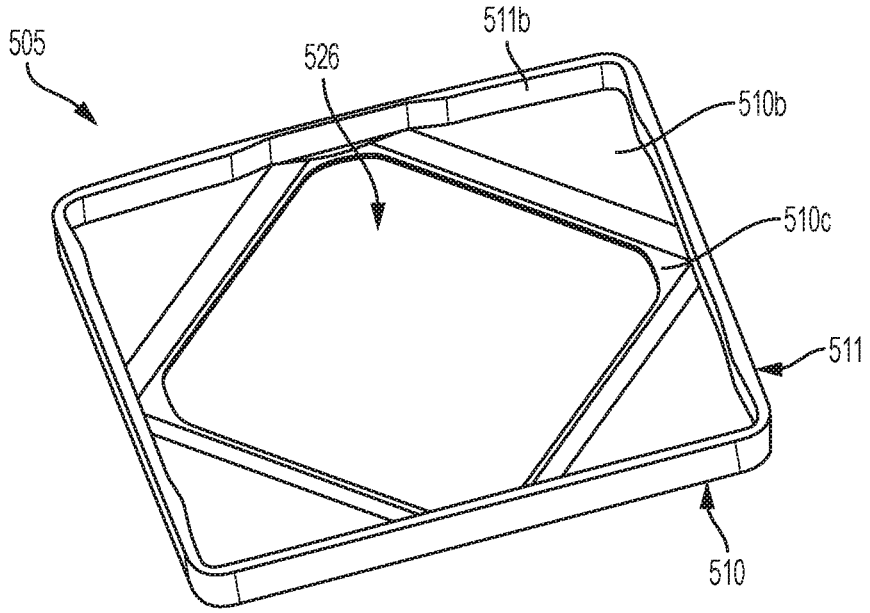
FIG. 5C is a perspective view of an interior of the front face of the flat panel antenna enclosure of FIG. 5A in accordance with some embodiments.
Figure 5D:
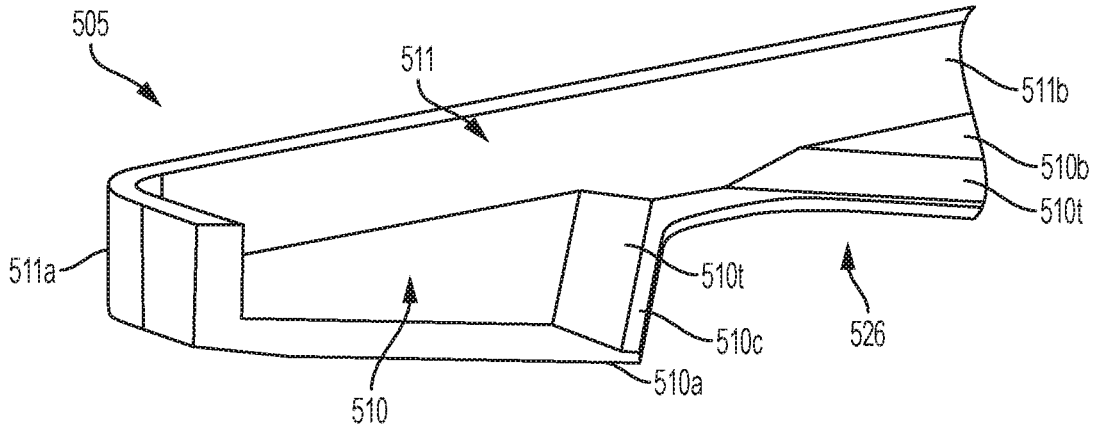
FIG. 5D is an enlarged view of an interface between sidewall surfaces and an internal surface of the interior of the front face of the flat panel antenna enclosure of FIG. 5C.

FIG. 5C and FIG. 5D (which is an enlarged view of an edge portion of FIG. 5C) illustrate the interior of the enclosure 505, and in particular, the internal surface 510*b* of the front face 510, which is opposite to the external surface 510*a* illustrated in FIGS. 5A and 5B. As shown in FIGS. 5C and 5D, the inner or internal surface 510*b* of the front face 510 is bounded by inner surfaces 511*b* of the sidewalls 511. The opening 526 in the front face 510 extends from the external surface 510*a* to the internal surface 510*b*. A thickness of the front face 510 (as defined between the external surface 510*a* and the internal surface 510*b*) is non-uniform; however, in contrast to the step difference 410*s* shown in the embodiments of FIGS. 4A-4E (which may be impractical to implement in some manufacturing processes where substantial variation of polymer thickness may be difficult to achieve), embodiments described herein provide a front face 510 having a thickness that tapers from a greater thickness T1 (between the external surface 510*a* and the internal surface portion 510*b* adjacent the sidewall surfaces 511) to a lesser thickness T2 (between the external surface 510*a* and an internal surface portion 510*c* adjacent or surrounding the opening 426), as shown in greater detail in the cross-sectional view of FIG. 5E.

Figure 5E:
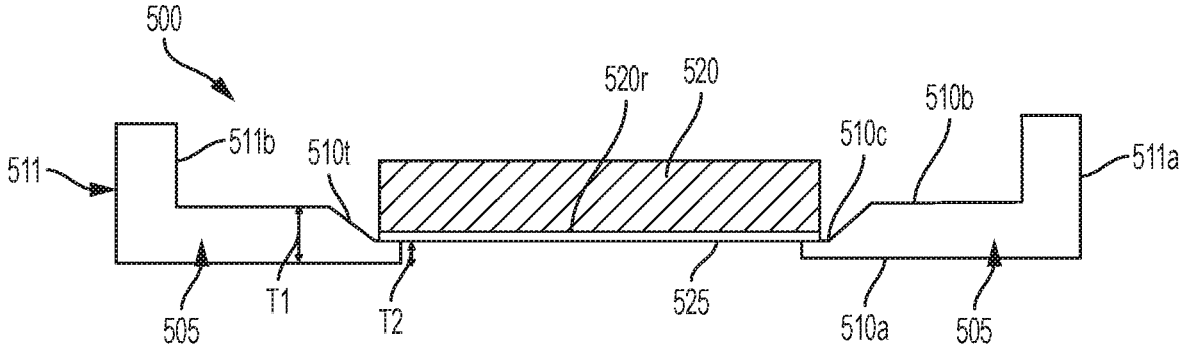
FIG. 5E is a cross-sectional view of the front face of the flat panel antenna structure of FIG. 5A including a radiator element therein in accordance with some embodiments.

Referring to FIG. 5E, the antenna structure 500 includes an antenna or radiator element 520 that is housed within the sidewall surfaces 511 and adjacent the front face 510 of the enclosure 505. A protective radome 525 is attached or otherwise provided on a radiating surface 520*r* of the radiator element 520. The opening 526 in the front face 510 is sized to expose the surface 520*r* of the radiator element 520 that includes the radome 525 thereon. In the example of FIG. 5E, the dimensions of the opening 526 are smaller than the dimensions of the surface 520*r* of the radiator element 520, such that a portion 510*c* of the internal surface 510*b* of the front face 510 overlaps with edges of the radome 525, defining a border around the perimeter of the radiating surface 520*r* of the radiator element 520. The surface 520*r* of the radiator element 520 including the radome 525 thereon is thus recessed relative to the external surface 510*a* of the front face 510 of the enclosure 505. However, it will be understood that the opening 526 may have the same or larger dimensions than the surface 520*r* of the radiator element 520, and thus, the radome 525 may be coplanar with or protrude beyond the external surface 510*a* of the front face 510 of the enclosure 505 in some embodiments.

As shown in FIGS. 5C-5E, the front face 510 of the enclosure 505 includes areas having a non-uniform or varying thickness, where a thickness T1 (between the external surface 510*a* and the internal surface 510*b* in the area adjacent the sidewall surfaces 511) differs from a thickness T2 (between the external surface 510*a* and the internal surface 510*c* adjacent the opening 526). The thickness T1 of the front face 510 adjacent the sidewall surfaces 511 may be selected or otherwise configured to provide the enclosure 505 with sufficient structural rigidity for environmental protection of the radiator element 520, while the thickness T2 of the front face 510 adjacent the opening 526 may be selected or otherwise configured so as not reduce or avoid negative effects on the radiative performance of the radiator element 520. A sloped or tapered portion 510*t* is thereby defined at an interface between the internal surface 510*b* and the internal surface 510*c* over the thickness of the front face 510 of the enclosure. The tapered portion 510*t* may taper linearly and/or non-linearly (i.e., may include straight and/or curved/rounded areas) in some embodiments. The smaller thickness T2 adjacent the opening 526 allows the radiating surface 520*r* of the radiator element 520 to be positioned closer to the external surface 510*a* than the internal surface 510*b* of the front face 510 of the enclosure, which may improve radiative performance. Also, by avoiding an abrupt change in thickness, the tapered portion 510*t* between the areas 510*b*, 510*c* of different thicknesses T1, T2 may be easier to manufacture in comparison to the stepped portion 410*s* shown in FIGS. 4A-4E.

The radome 525 on the radiating surface 520*r* of the radiator element 520 may have a thickness that is less than the thickness T2, and may be formed of the same or a different material than the enclosure 505. Also, the amount of overlap between the internal surface 510*c* and the perimeter of the radiating surface 520*r* is shown for purposes of illustration only, and may be reduced or increased to provide improved or optimal performance of the radiator element 520.

Figure 9A:
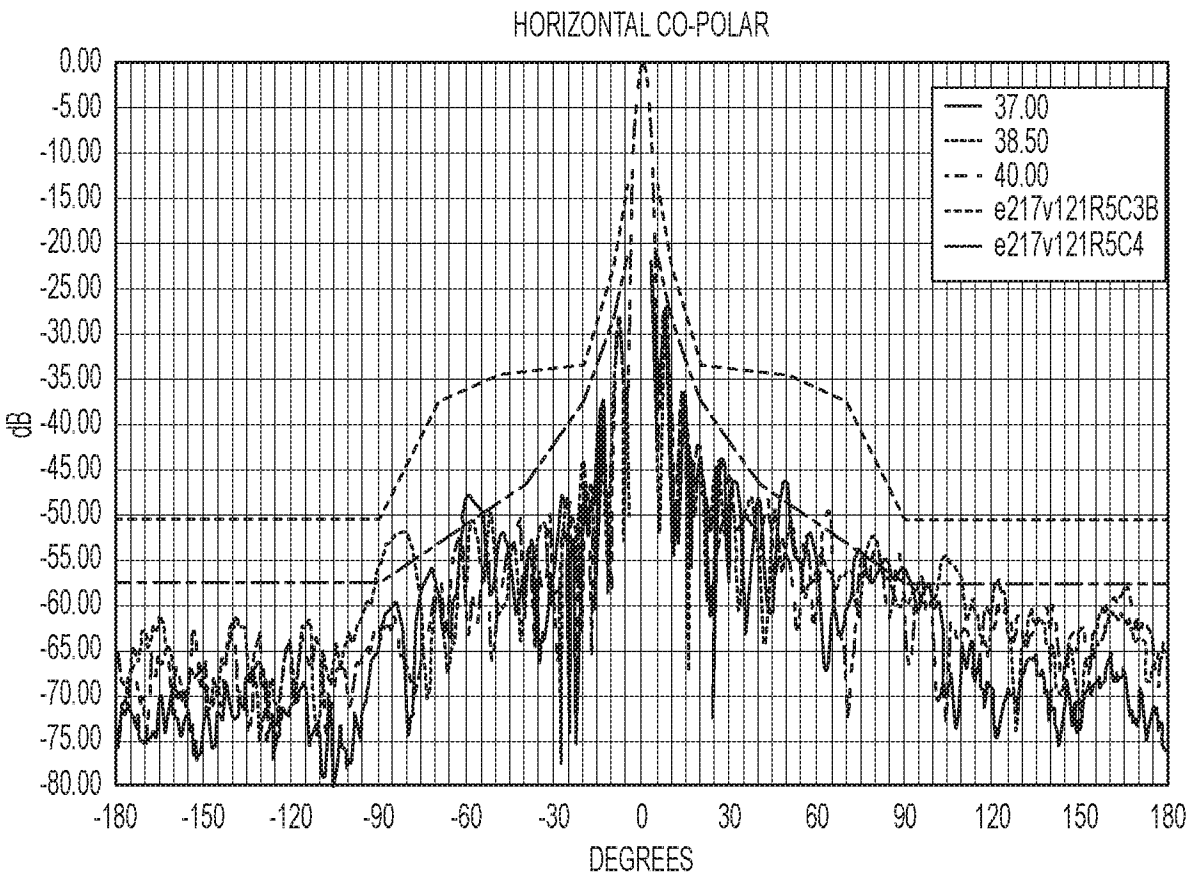
FIGS. 9A-9D are graphs illustrating performance of a flat panel antenna structure having a front face with a stepped thicknesses in accordance with some embodiments.
Figure 9B:
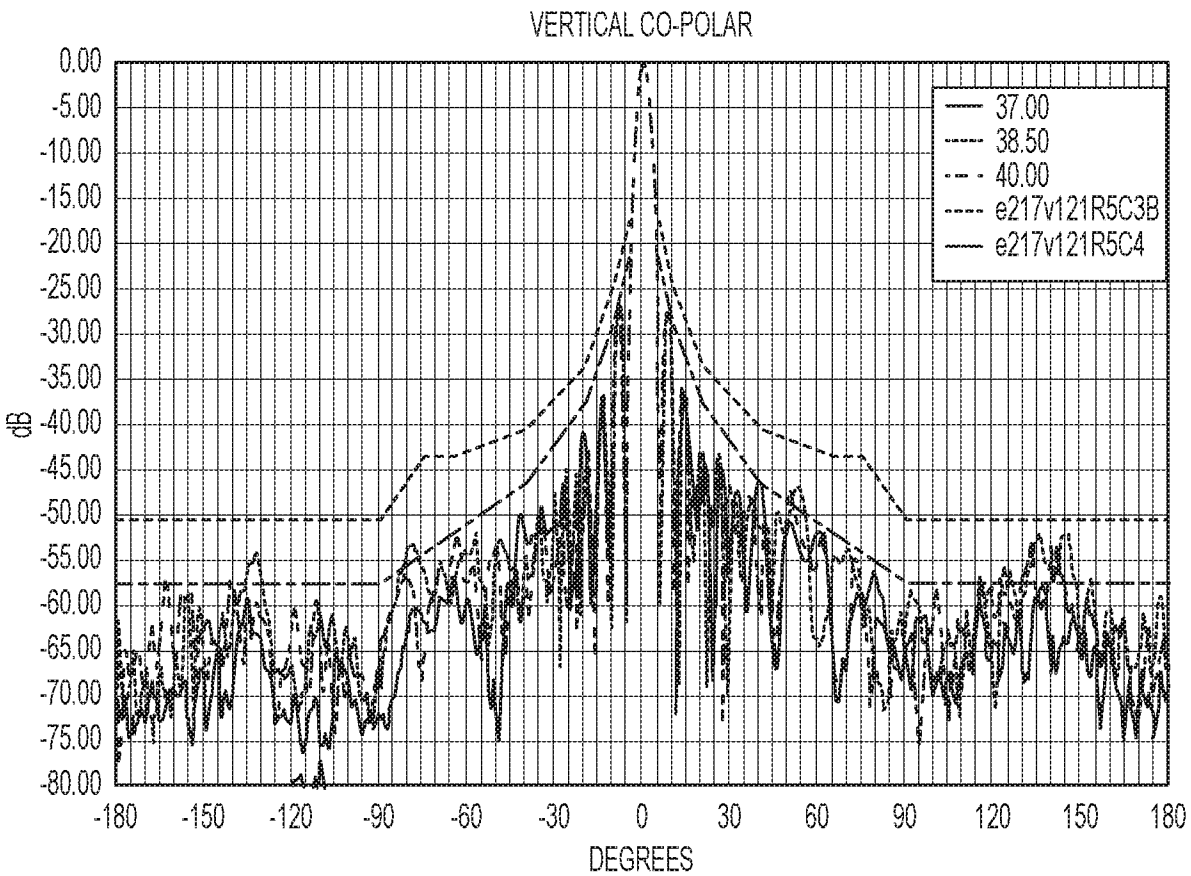
Figure 9C:
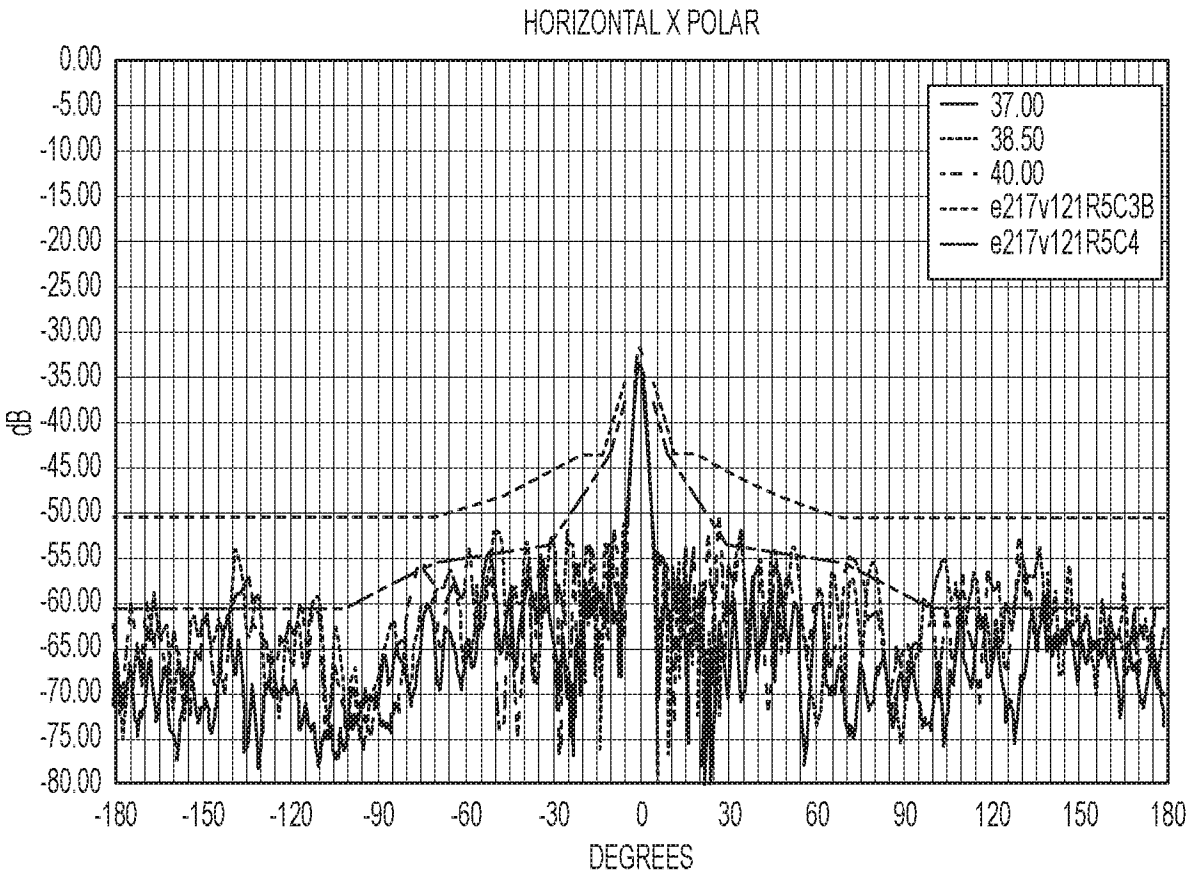
Figure 9D:
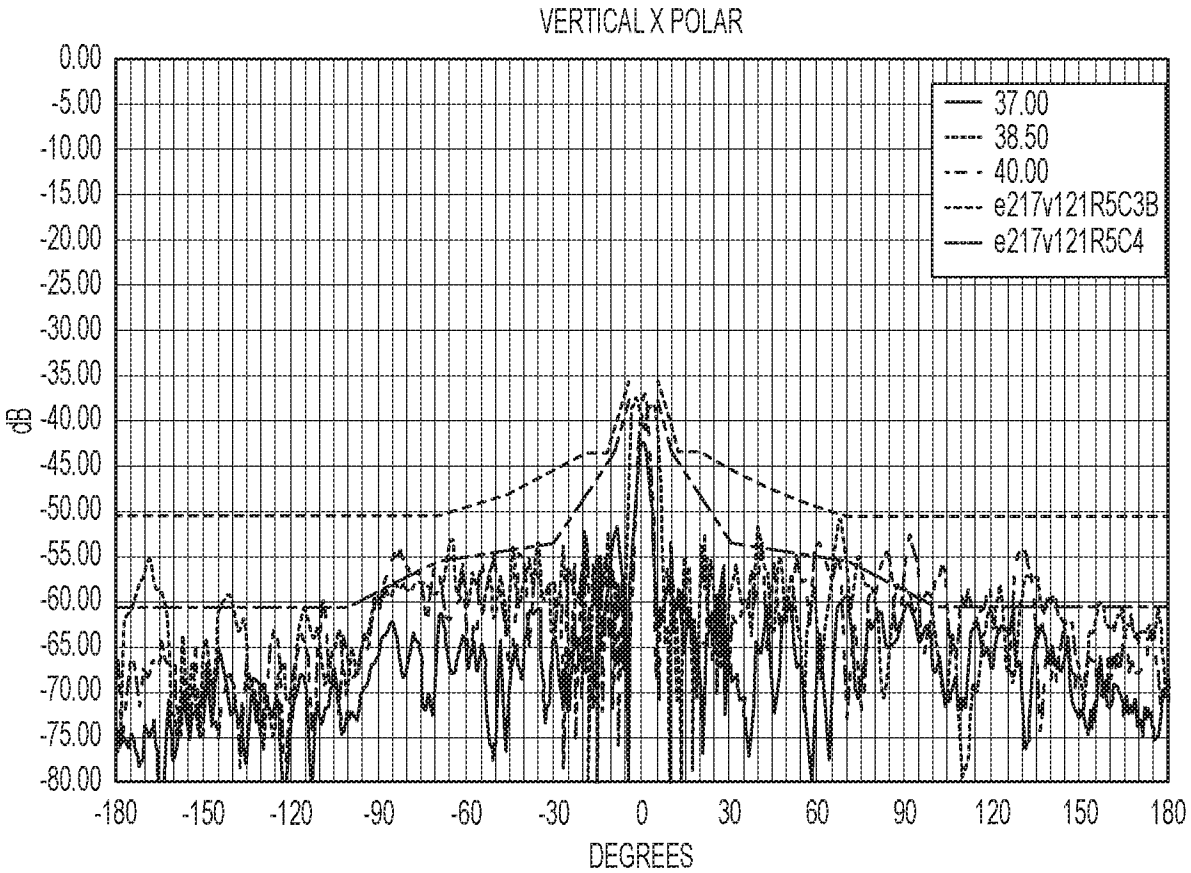
Figure 10A:
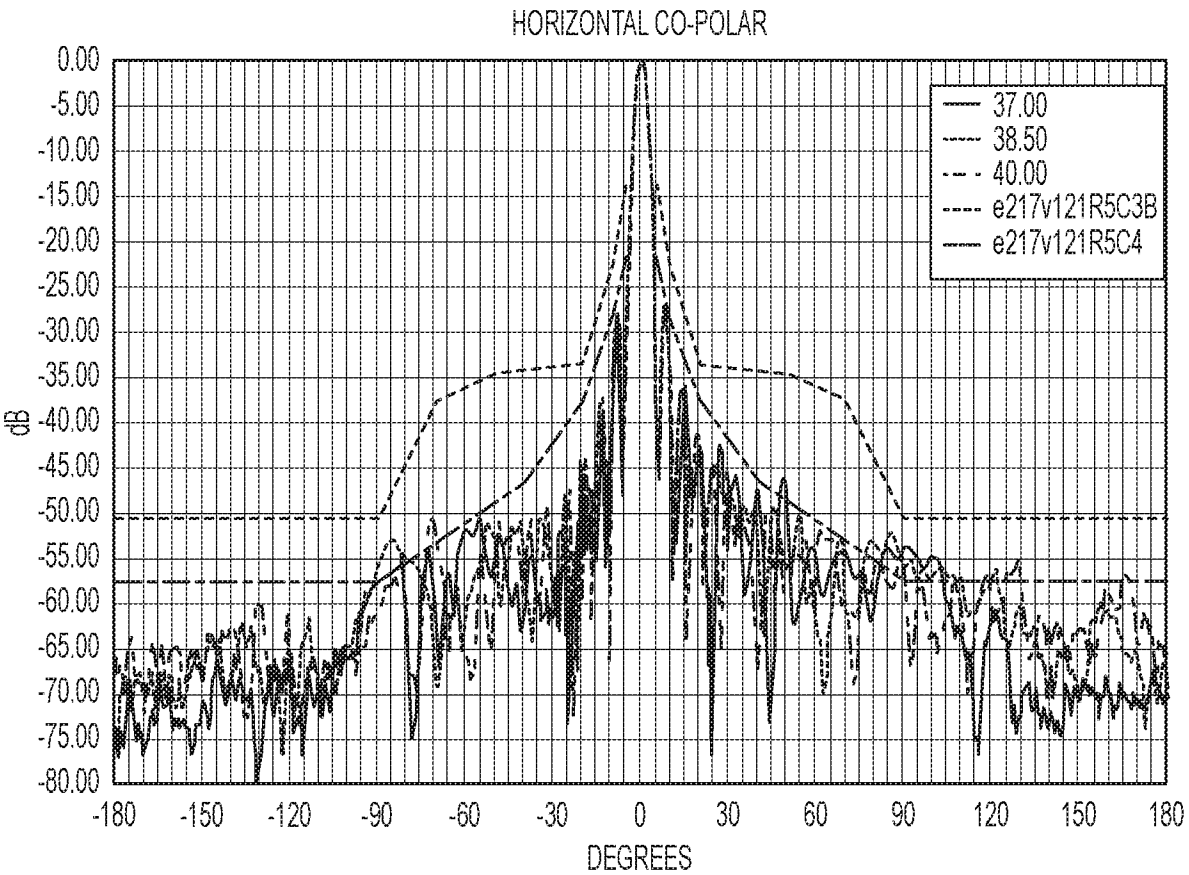
FIGS. 10A-10D are graphs illustrating performance of a flat panel antenna structure having a front face with a tapered thickness in accordance with some embodiments.
Figure 10B:
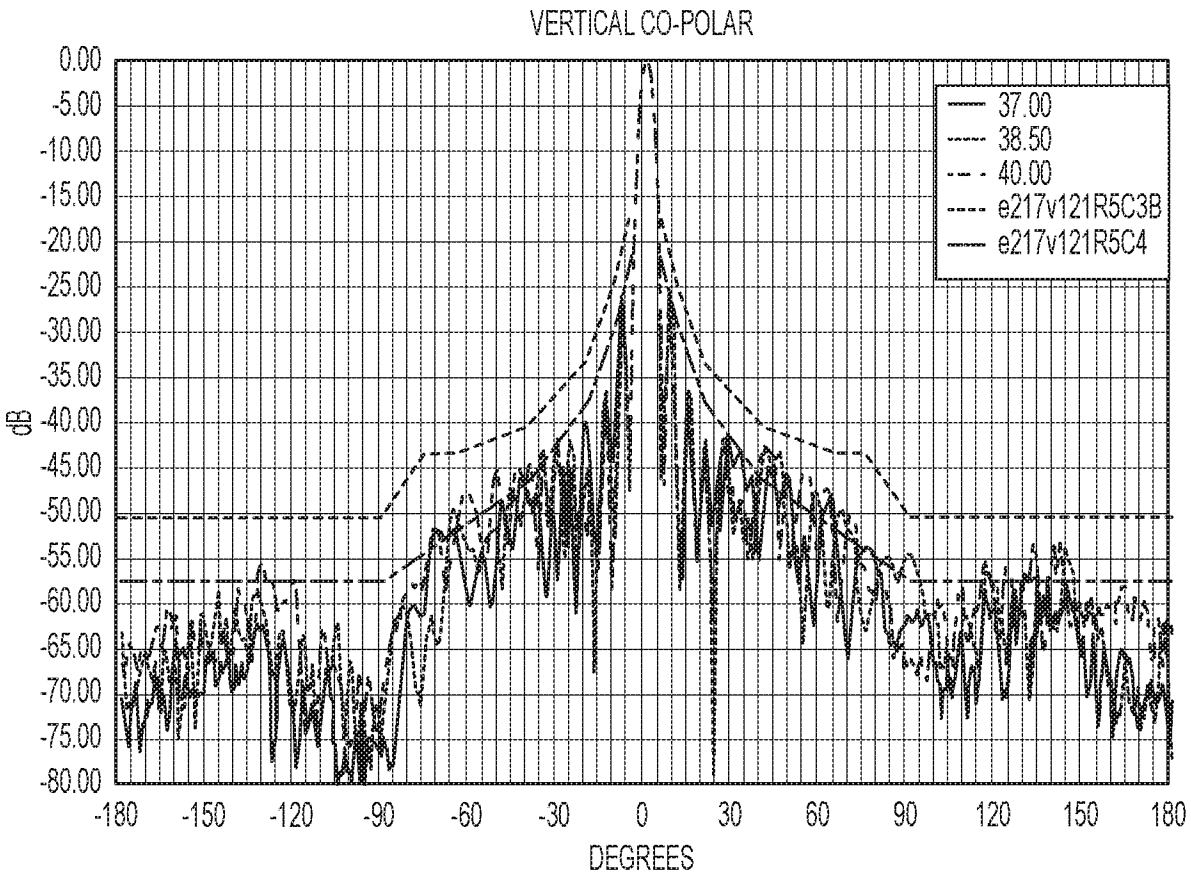
Figure 10C:
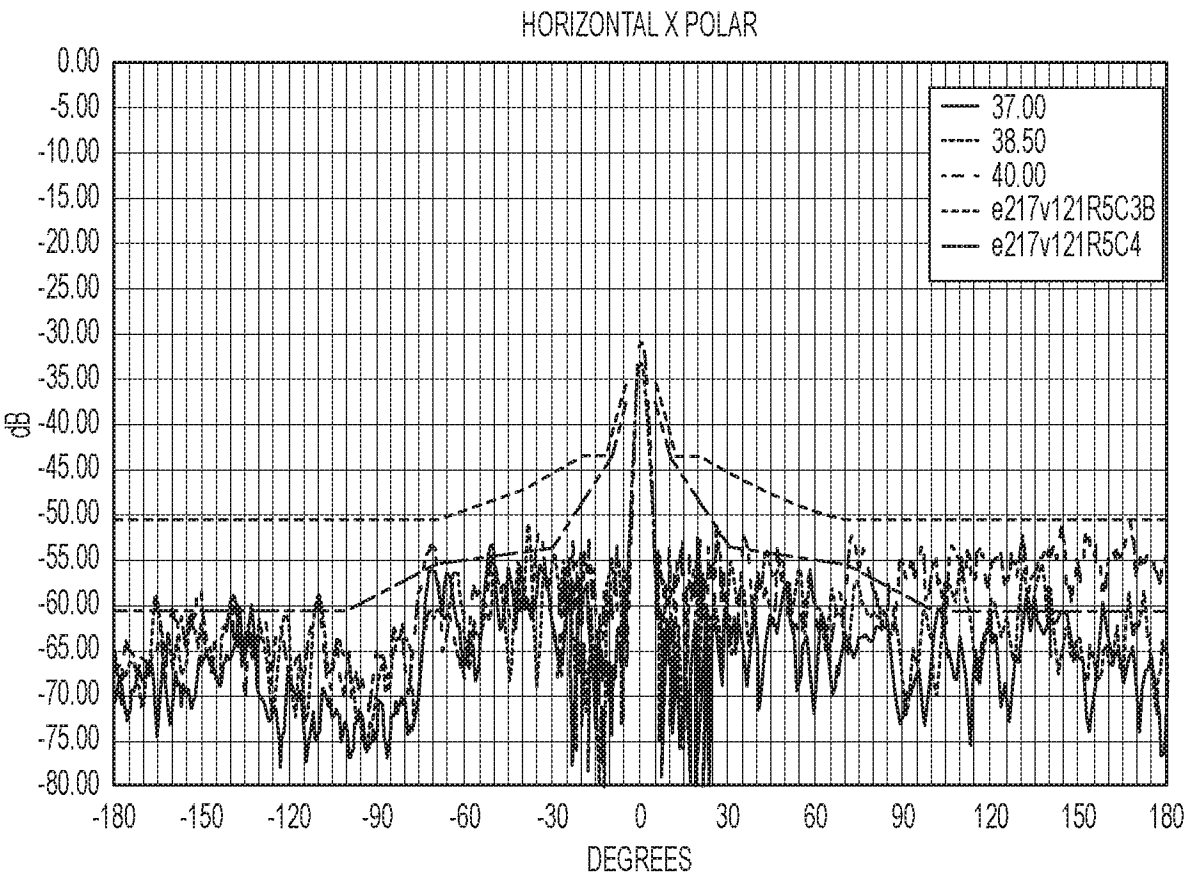
Figure 10D:
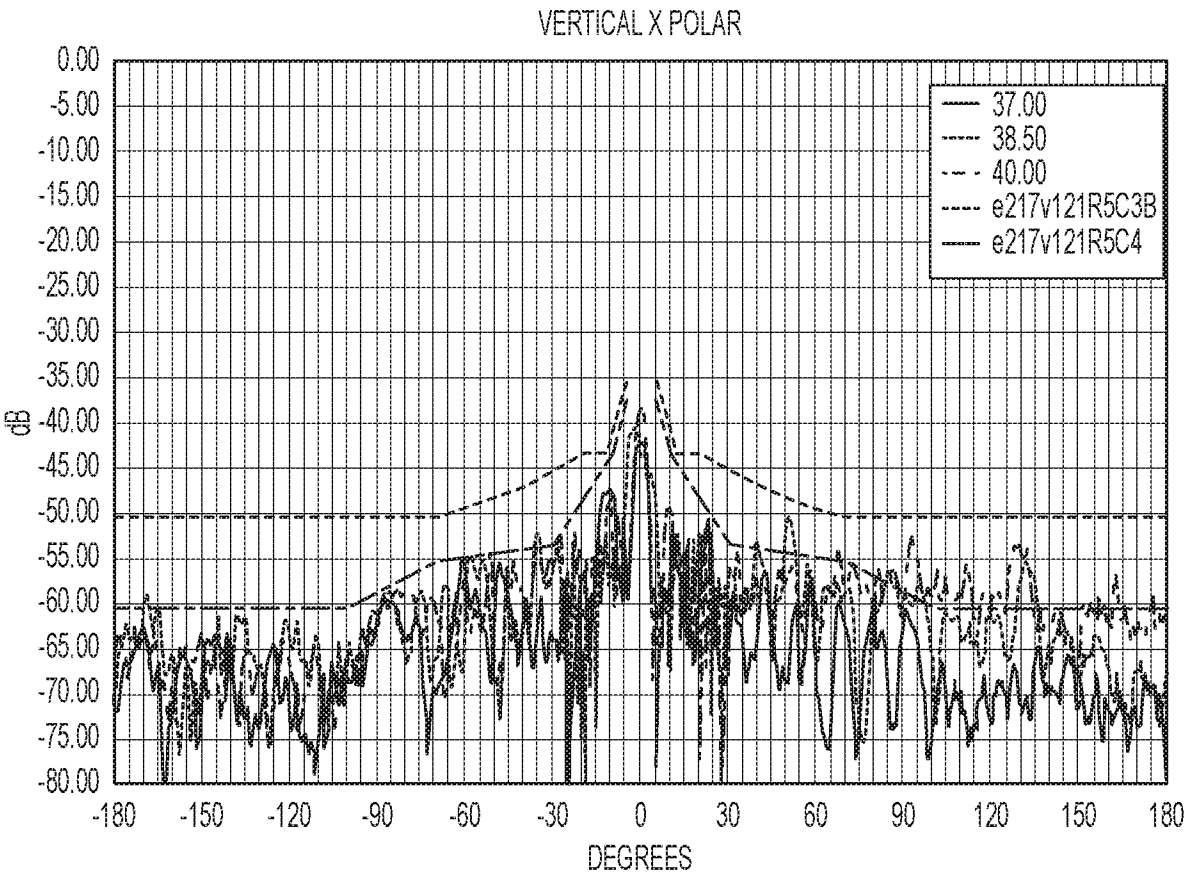
Figure 11A:
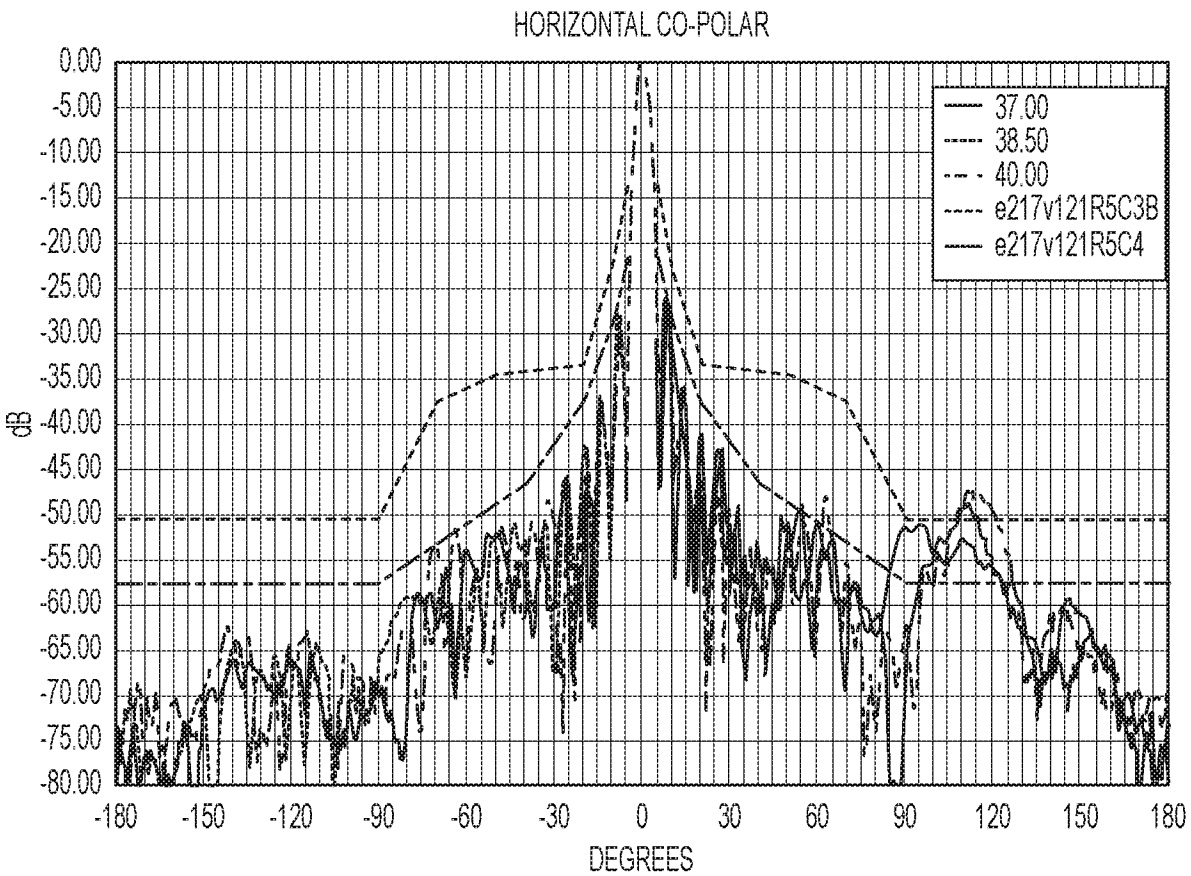
FIGS. 11A-11D are graphs illustrating performance of a production sample flat panel antenna structure having a front face with a tapered thickness in accordance with some embodiments.
Figure 11B:
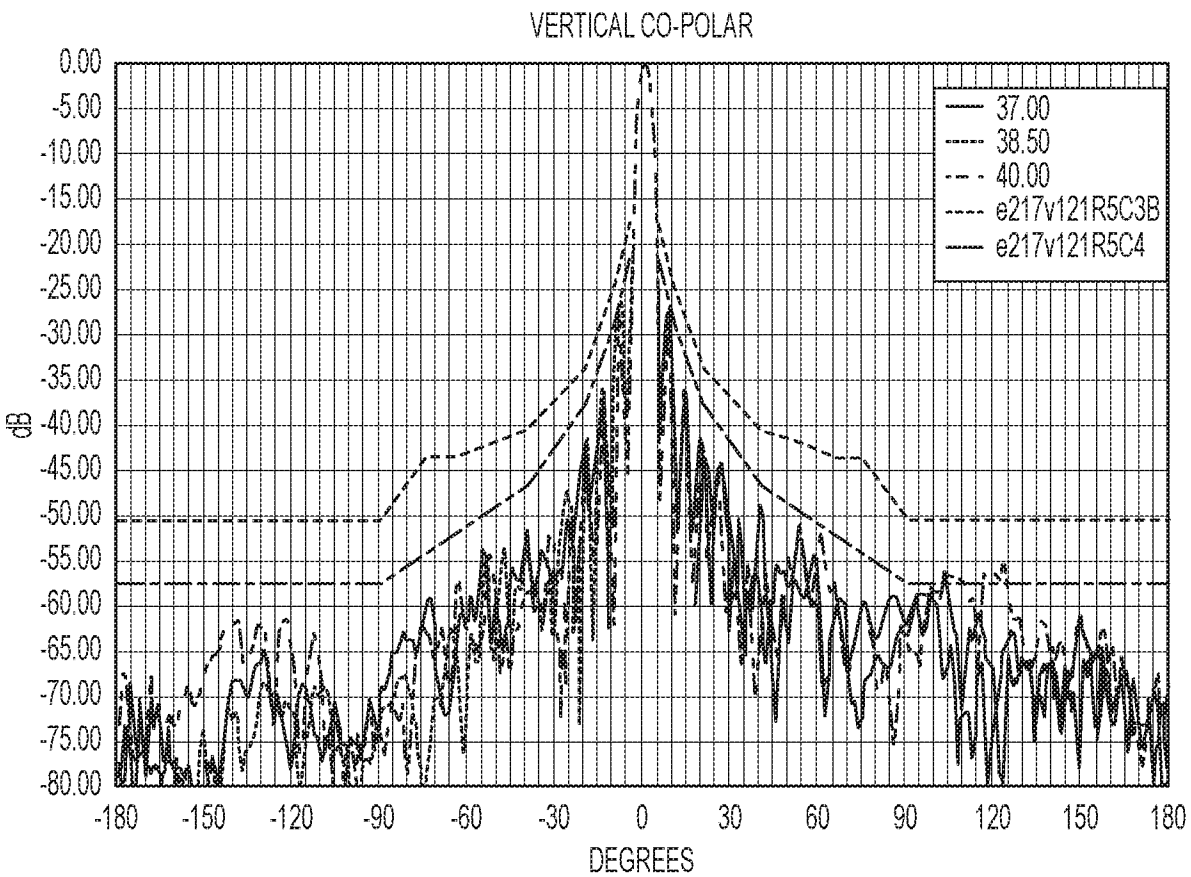
Figure 11C:
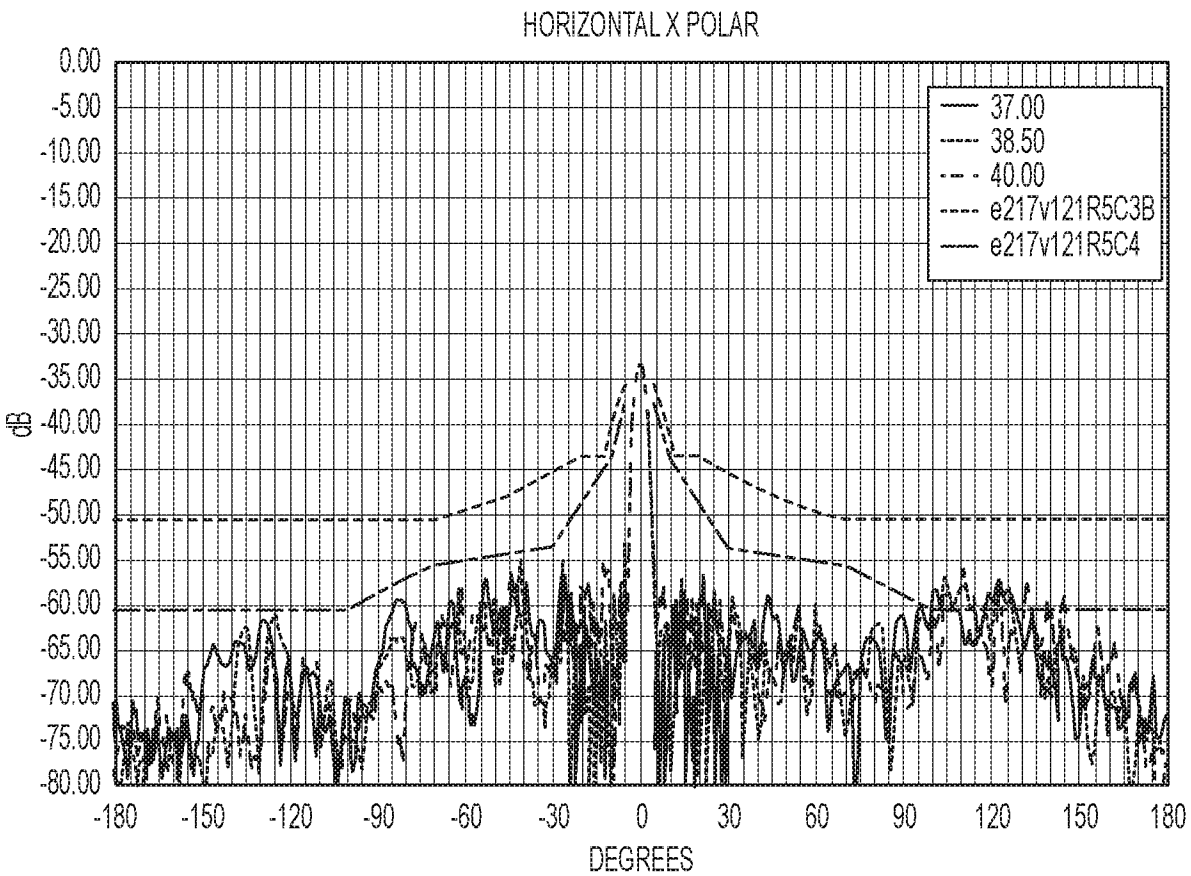
Figure 11D:
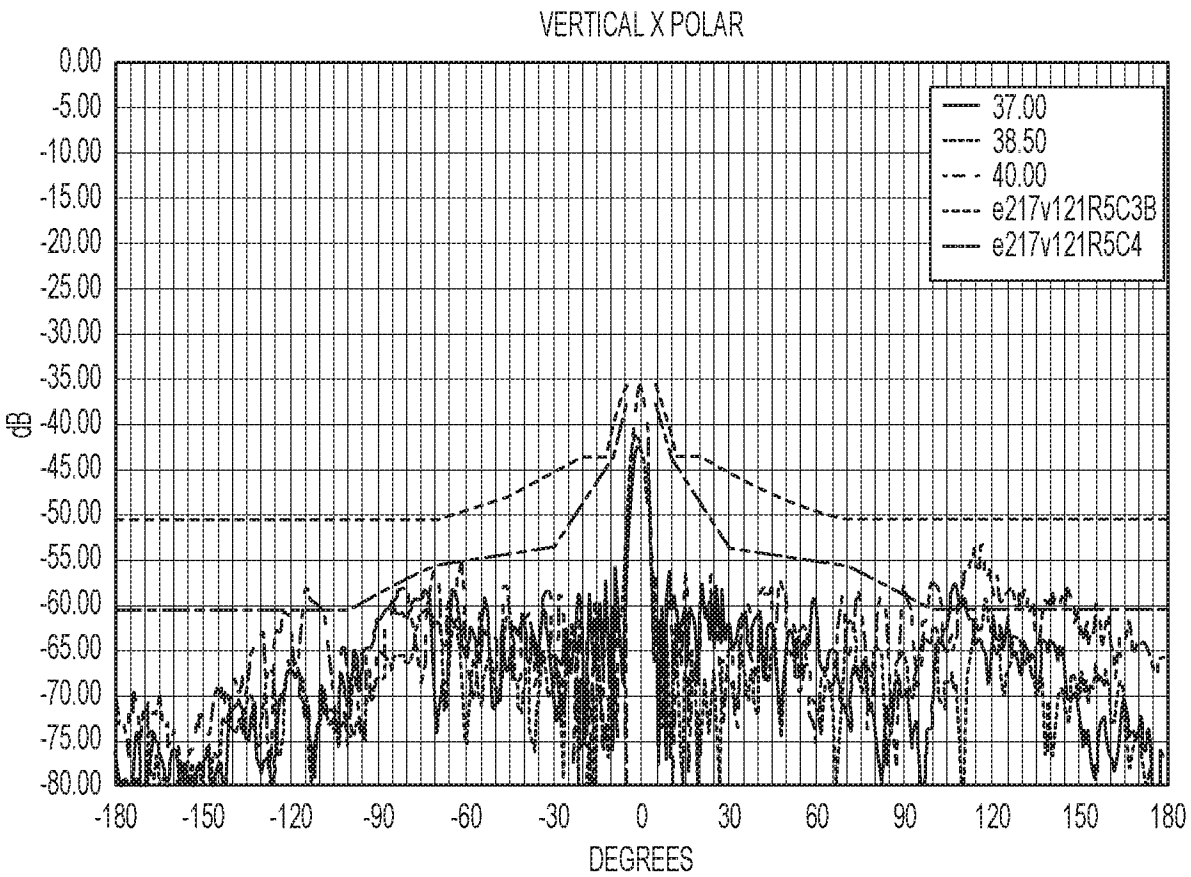

Some performance characteristics of antenna structures including two-part radome-enclosures as illustrated in FIGS. 4A-4E and 5A-5E are illustrated in the graphs of FIGS. 9A-9D and 10A-10D, respectively, over a ±180 degree azimuth angle range. In particular, FIGS. 9A-9D illustrate performance of the antenna structure 400 having a front face 410 including a stepped thickness in cross-section, while FIGS. 10A-10D illustrate performance of the antenna structure 500 having a front face 510 including a tapered thickness in cross-section. In the example of FIGS. 10A-10D, the enclosure is a machined-from-solid enclosure with glued additional components. As shown in FIGS. 9A, 9B, 10A, and 10B, horizontal and vertical co-polarization characteristics of the embodiments of FIGS. 9A and 9B are substantially similar to the embodiments of FIGS. 10A and 10B, respectively. Likewise, as shown in FIGS. 9C, 9D, 10C, and 10D, horizontal and vertical cross-polarization characteristics of the embodiments of FIGS. 9C and 9D are substantially similar to the embodiments of FIGS. 10C and 10D, respectively. As such, based on the graphs of FIGS. 9A-9D and 10A-10D, embodiments of enclosures described herein having stepped front face cross-sections may offer performance similar to embodiments of enclosures described herein having tapered front face cross-sections, as both of such embodiments allow for positioning of the radiating surface of the radiator element very close to (or protruding beyond) the exterior surface of the front face of the enclosure. However, as the embodiments having front faces with tapered thicknesses are free of abrupt changes in thickness, such embodiments may be preferable from a manufacturing standpoint as compared to embodiments having front faces with stepped thicknesses.

Figure 6A:
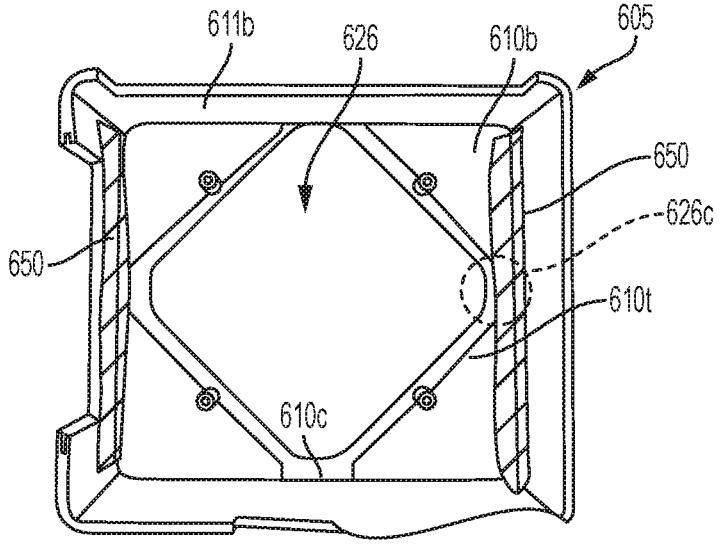
FIGS. 6A, 6B, and 6C are views of an interior of a flat panel antenna enclosure including metalized sidewall surfaces in accordance with some embodiments.
Figure 6B:
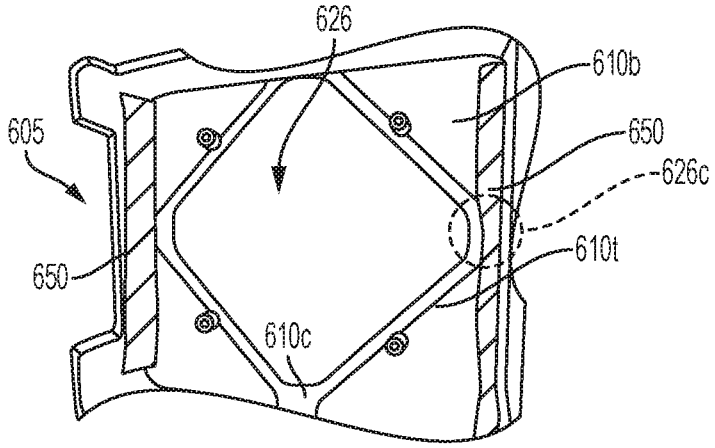
Figure 6C:
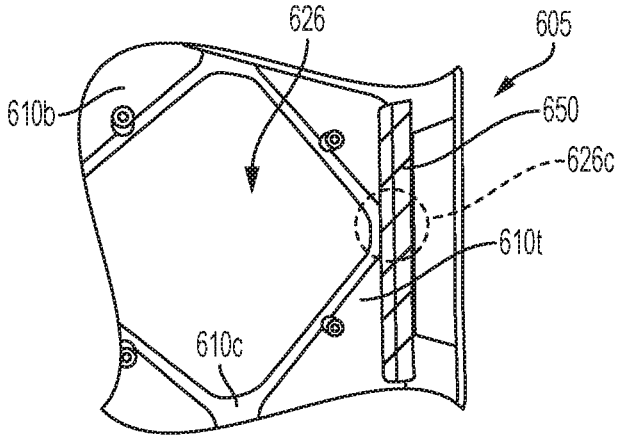

FIGS. 6A, 6B, and 6C are views of an interior of a flat panel antenna enclosure formed from a non-conductive material (such as injection-molded plastic) and further including metallized sidewall surfaces in accordance with some embodiments, which may offer improved performance. As shown in FIGS. 6A-6C, the internal surface 610*b* of the front face of the enclosure 605 is bounded by inner sidewall surfaces 611*b*, and an opening 626 extends through the front face from the internal surface 610*b* to an external surface of the enclosure 605. The opening 626 is sized and configured to expose or accept a radome that is attached to a radiating surface of a radiator element, such as the radome 525 that is attached to the radiating surface 520*r* of the radiator element 520 in the embodiment of FIGS. 5A-5E. A sloped or tapered portion 610*t* (similar to the portion 510*t* of FIG. 5E) is defined over the thickness of the front face 610 of the enclosure, between the internal surface 610*b* adjacent the sidewall surfaces 611*b* and an internal surface 610*c* adjacent the opening 626. Thus, the front face of the enclosure 605 includes a non-uniform or varying thickness, allowing a radiating surface of a radiator element to be positioned closer to the external surface of the front face of the enclosure 605.

Still referring to FIGS. 6A-6C, some embodiments described herein may further include one or more metal layers 650 on one or more of the inner sidewall surfaces 611*b* of the enclosure 605. In the example of FIGS. 6A-6C, respective metal layers 650 are implemented using aluminum strips or tape on opposite inner sidewall surfaces 611*b* of the enclosure; however, it will be understood that the metal layers 650 may be implemented using other metals and/or materials in some embodiments. For example, other forms or types of metallization (including, but not limited to electro(less) plating, Electrodag® coating, metal paint, etc.) may be used in some embodiments. Also, while illustrated in FIGS. 6A-6C as extending from the inner sidewall surfaces 611*b* onto the internal surface 610*b* of the front face, it will be understood that the metal layers 650 may be confined to or embedded within the sidewall surfaces 611*b* in some embodiments.

In FIGS. 6A-6C, the metal layers 650 are respectively provided on particular opposing sidewall surfaces 611*b* that correspond to the azimuth plane of the radiator element housed within the enclosure 605. That is, when the antenna structure (including the enclosure 605 and internal radiator element) is mounted or otherwise employed in a telecommunications device or apparatus, the metal layers 650 are provided on the sidewall surfaces 611*b* that are oriented to affect the azimuth angle of the desired antenna coverage pattern. Additionally or alternatively, it will be understood that metal layers 650 can be included on opposing sidewall surfaces 611*b* of the enclosure 605 that are oriented to affect the elevation angle/correspond to the elevation plane of the radiator element in some embodiments.

In addition, it will be understood that the metal layers 650 need not extend along a majority or entirety of the opposing sidewall surfaces 611*b*. Rather, improvements in the radiating pattern of the radiator element may be achieved in some embodiments by positioning the metal layers 650 adjacent or closest to edge portions of the radiator element. In FIGS. 6A-6C, the opening 626 is designed to correspond to the shape of the radiator element to be included in the enclosure 605; thus, in the illustrated embodiments, the metal layers 650 may be positioned adjacent to (or in some embodiments, may be confined to) corner portions 626*c* of the opening 626 in the front face of the enclosure 605.

Figure 12A:
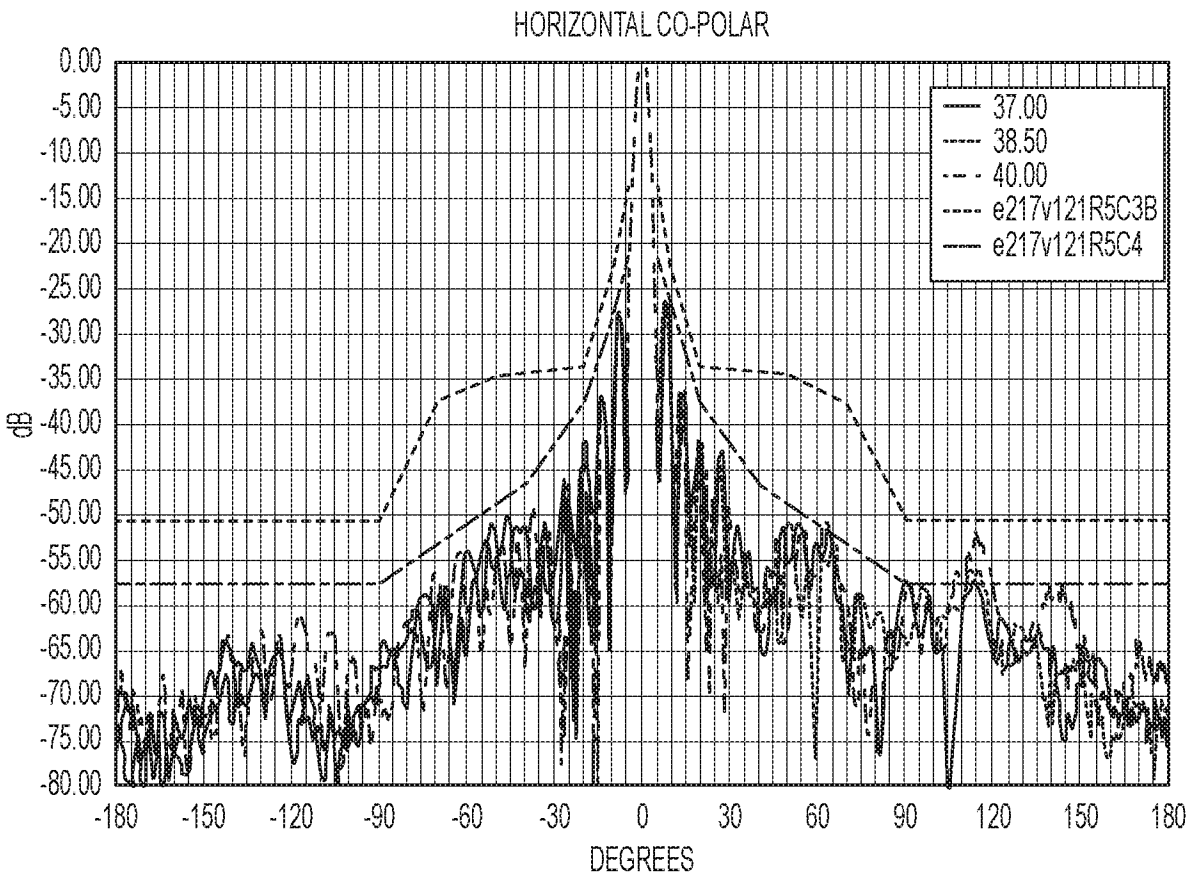
FIGS. 12A-12D are graphs illustrating performance of a flat panel antenna structure having a front face with a tapered thickness and metallized sidewall surfaces in accordance with some embodiments.
Figure 12B:
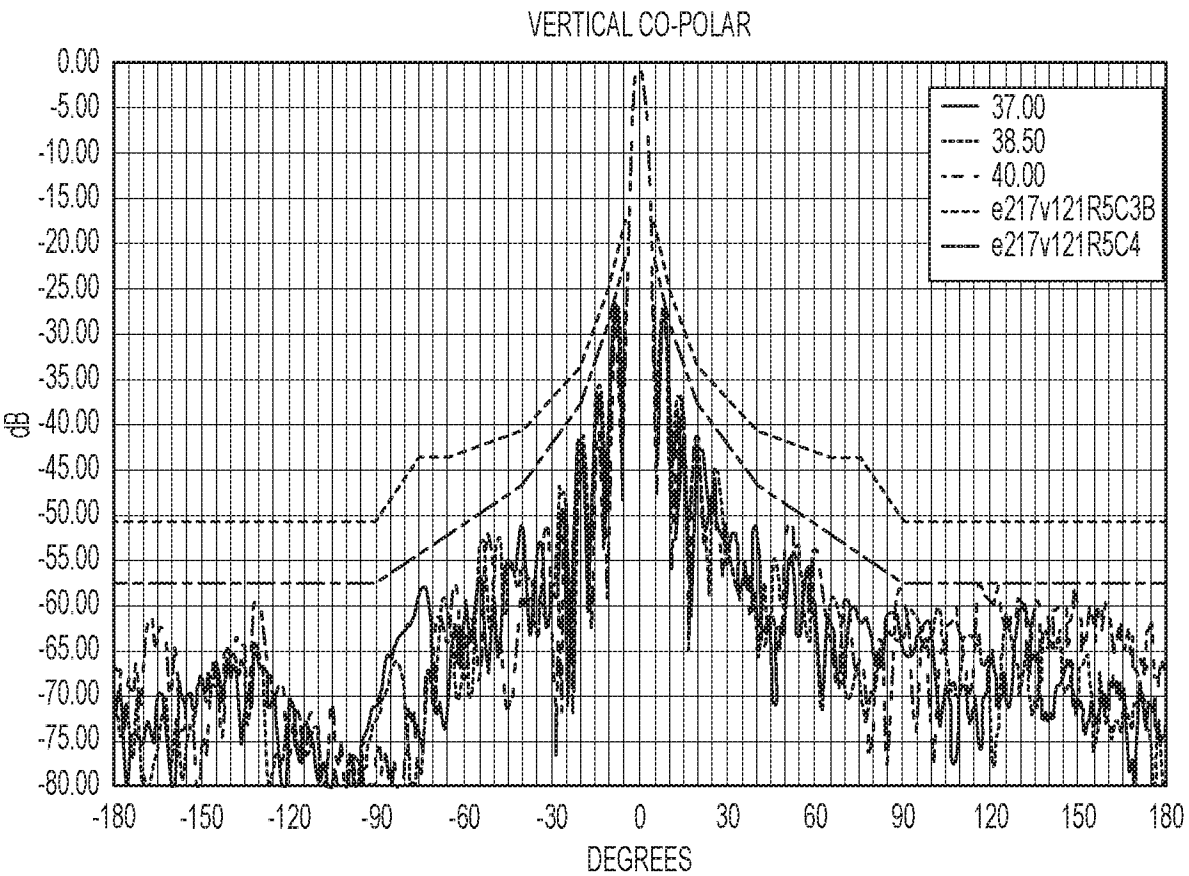
Figure 12C:
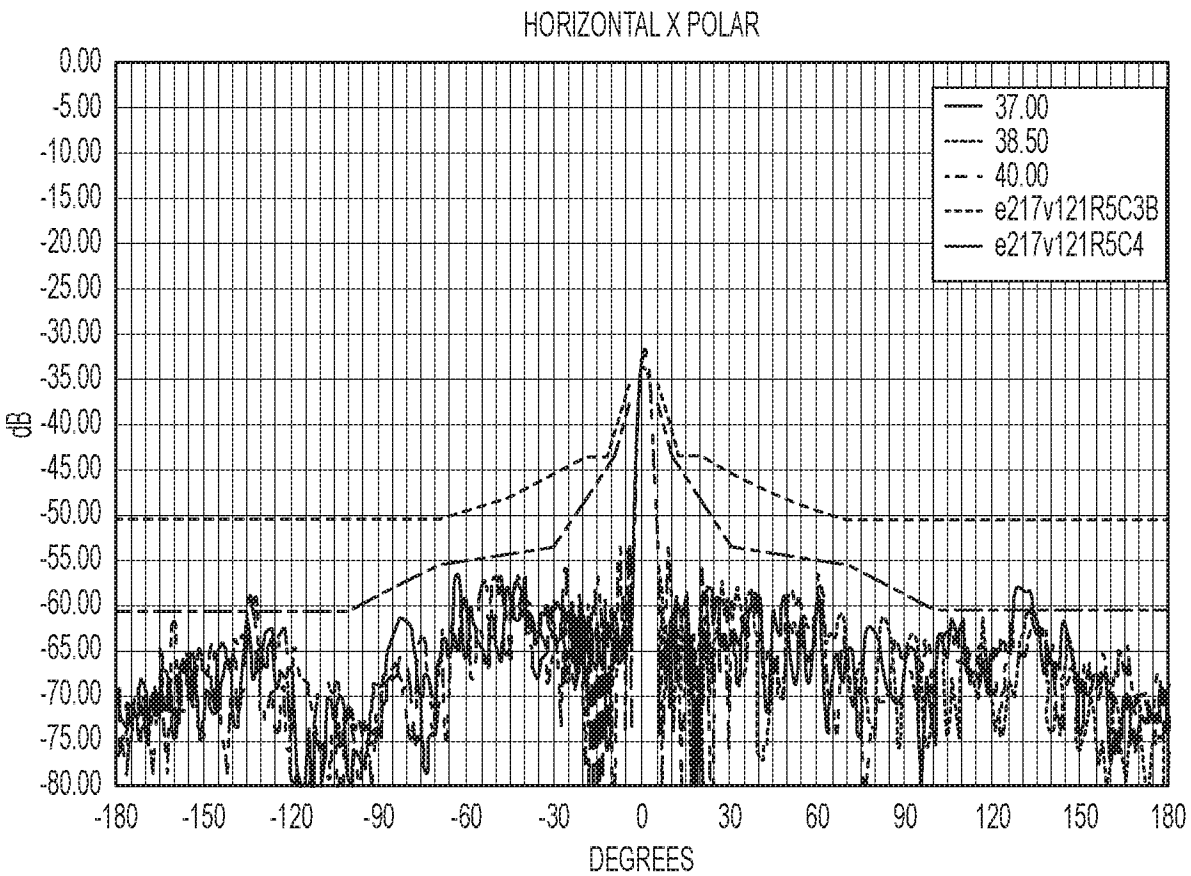
Figure 12D:
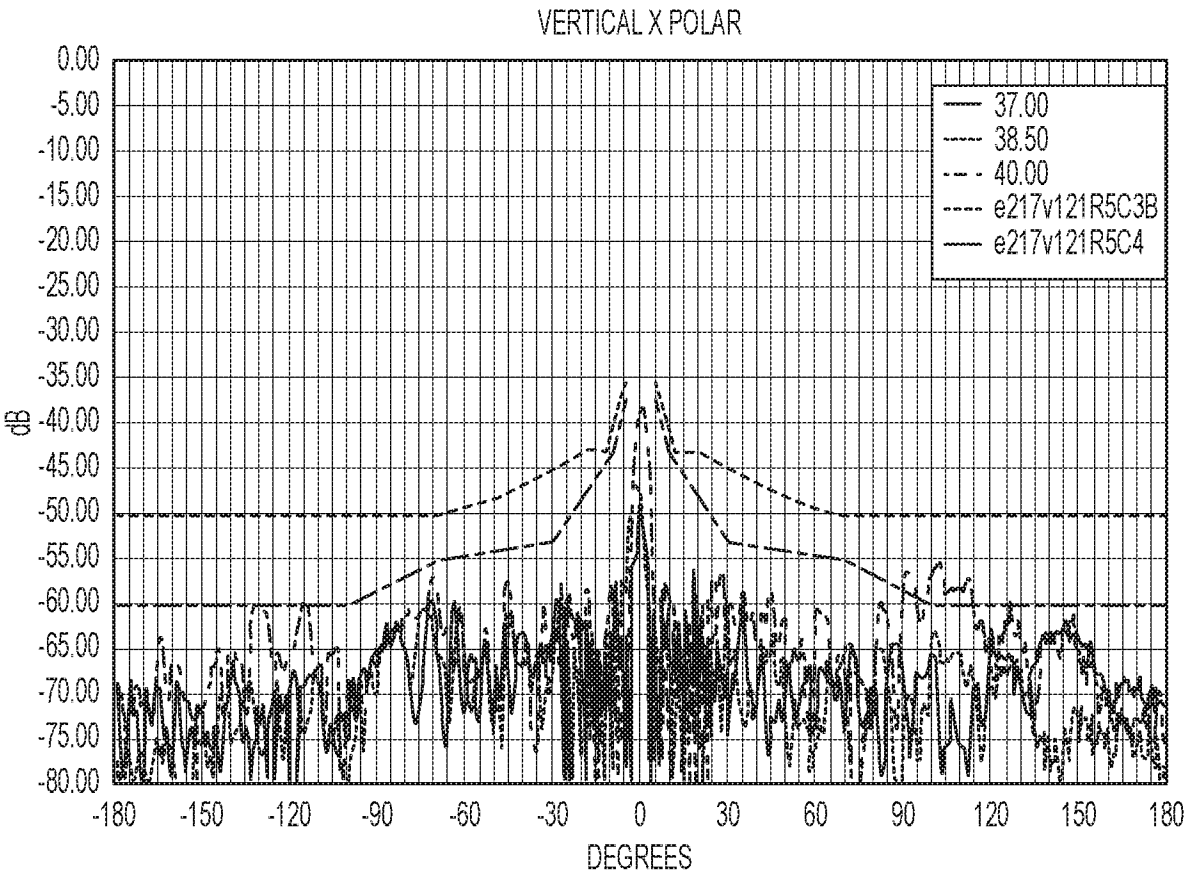

Some performance characteristics of antenna structures including two-part radome-enclosures are illustrated in the graphs of FIGS. 11A-11D and 12A-12D over a ±180 degree azimuth angle range. In particular, FIGS. 11A-11D illustrate performance of the antenna structure having a front face including a tapered thickness in cross-section (such as the structure 505 of FIG. 5A-5E), while FIGS. 12A-12D illustrate performance of the antenna structure having a front face including a tapered thickness in cross-section along with metal layers on internal sidewall surfaces that are oriented to affect the azimuth angle (such as the structure 605 of FIG. 6A-6C). In the examples of FIGS. 11A-11D and 12A-12D, the enclosures are a single piece injection molded enclosure. As shown in the graphs of FIGS. 12A-12D, the inclusion of the metal layers on the opposing internal sidewall surfaces of the enclosure corresponding to the azimuth plane of the antenna structure may offer improved performance in the 100-120 degree region where measured radiation patterns are made compliant to the desired specification e217v121R5C3B, as compared to the antenna structure FIGS. 11A-11D, which does not include the metal layers. In particular, as shown in FIGS. 11A, 11B, 12A, and 12B, horizontal and vertical co-polarization characteristics are improved in the embodiments of FIGS. 12A and 12B as compared to the embodiments of FIGS. 11A and 11B, respectively. Likewise, as shown in FIGS. 11C, 11D, 12C, and 12D, the horizontal and vertical cross-polarization characteristics of the embodiments of FIGS. 12C and 12D are improved as compared to the horizontal and vertical cross-polarization graphs of FIGS. 11C and 11D, respectively. Thus, the inclusion of the metal layers in one or more of the sidewall surfaces of the enclosure may offer further improvements in radiative performance.

From the foregoing, it will be apparent that embodiments of the present invention provide a high performance flat panel antenna with a front face having a non-uniform or varying cross-sectional thickness that is strong, lightweight and may be repeatedly cost efficiently manufactured with a very high level of precision.

Embodiments of the present invention have been described above with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element is referred to as being "on" another element, it can be directly on the other element or intervening elements may also be present. In contrast, when an element is referred to as being "directly on" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (i.e., "between" versus "directly between", "adjacent" versus "directly adjacent", etc.).

Relative terms such as "below" or "above" or "upper" or "lower" or "horizontal" or "vertical" may be used herein to describe a relationship of one element, layer or region to another element, layer or region as illustrated in the figures. It will be understood that these terms are intended to encompass different orientations of the device in addition to the orientation depicted in the figures.

Unless otherwise defined, all technical and scientific terms used herein have the same meaning as commonly understood by one of ordinary skill in the art to which this invention belongs. The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Aspects and elements of all of the embodiments disclosed above can be combined in any way and/or combination with aspects or elements of other embodiments to provide a plurality of additional embodiments.

In the drawings and specification, there have been disclosed typical embodiments of the invention and, although specific terms are employed, they are used in a generic and descriptive sense only and not for purposes of limitation, the scope of the invention being set forth in the following claims.

That which is claimed:

1. An antenna structure, comprising:

a radiator element comprising an array of antenna elements; and an enclosure including the radiator element therein, the enclosure comprising a front face that is adjacent a surface of the radiator element, sidewall surfaces that house the radiator element therebetween, and a mounting interface configured to attach the enclosure including the radiator element therein to external telecommunications equipment, wherein the front face of the enclosure comprises an internal surface that is bounded by the sidewall surfaces and an external surface opposite the internal surface, wherein the surface of the radiator element is positioned closer to the external surface than the internal surface of the front face of the enclosure.

2. The antenna structure of claim 1, further comprising:

a radome adjacent the surface of the radiator element, wherein the external and internal surfaces define a thickness of the front face that varies therebetween, and wherein the radome has a thickness that is less than a maximum of the thickness defined between the external and internal surfaces of the front face of the enclosure.

3. The antenna structure of claim 2, wherein the thickness of the front face comprises a first thickness adjacent the sidewall surfaces and a second thickness adjacent the surface of the radiator element, wherein the first thickness is greater than the second thickness.

4. The antenna structure of claim 3, wherein the front face comprises a stepped portion between the first thickness and the second thickness.

5. The antenna structure of claim 3, wherein the front face comprises a tapered or beveled portion between the first thickness and the second thickness.

6. The antenna structure of claim 3, wherein the radome comprises an integral portion of the front face of the enclosure, the radome having the second thickness adjacent the surface of the radiator element.

7. The antenna structure of claim 3, wherein:

the front face of the enclosure comprises an opening extending therethrough from the external surface to the internal surface; and the radome is distinct from the enclosure, wherein the radome is on the surface of the radiator element and at least partially exposed by the opening.

8. The antenna structure of claim 7, wherein the radome comprises a different material from that of the enclosure.

9. The antenna structure of claim 7, wherein the surface of the radiator element including the radome thereon is recessed relative to the external surface of the front face of the enclosure.

10. The antenna structure of claim 9, wherein the front face comprises a border portion having the second thickness adjacent an edge of the opening, wherein the border portion overlaps with a perimeter of the radome and confines the radome within the enclosure.

11. The antenna structure of claim 7, wherein the surface of the radiator element including the radome thereon is coplanar with or protrudes beyond the external surface of the front face of the enclosure.

12. The antenna structure of claim 1, wherein the enclosure comprises a non-conductive material, and further comprising:

a metallized element adjacent an edge of the surface of the radiator element.

13. The antenna structure of claim 12, wherein the metallized element comprises respective metal layers on opposing ones of the sidewall surfaces of the enclosure.

14. The antenna structure of claim 13, wherein the opposing ones of the sidewall surfaces including the respective metal layers thereon are oriented to affect the azimuth angle of a coverage pattern of the radiator element.

15. The antenna structure of claim 1, wherein the radiator element is rotatable within the enclosure to alter a polarization of signals transmitted by the radiator element.

16. The antenna structure of claim 1, wherein the radiating element comprises a European Telecommunications Standards Institute (ETSI) Class 3 or Class 4 microwave antenna.

17. An antenna structure, comprising:

a radiator element comprising an array of antenna elements;

an enclosure including the radiator element therein, the enclosure comprising a front face that is adjacent a surface of the radiator element, sidewall surfaces that house the radiator element therebetween, and a mounting interface configured to accept mounting hardware that secures the enclosure to external telecommunications equipment, the front face comprising an opening extending therethrough from an external surface thereof to an internal surface thereof that is bounded by the sidewall surfaces; and a radome on the surface of the radiator element and at least partially exposed by the opening in the front face, wherein the surface of the radiator element including the radome thereon protrudes beyond the internal surface and towards the external surface of the front face.

18. The antenna structure of claim 17, wherein the radome has a thickness that is less than a thickness of the front face of the enclosure as defined between the external and internal surfaces thereof, and the surface of the radiator element including the radome thereon is positioned closer to the external surface than the internal surface.

19. The antenna structure of claim 18, wherein the thickness of the front face comprises a first thickness adjacent the sidewall surfaces and a second thickness adjacent the surface of the radiator element that includes the radome thereon, wherein the first thickness is greater than the second thickness and the thickness of the radome is less than the second thickness.

20. The antenna structure of claim 19, wherein the front face comprises a stepped or tapered portion between the first thickness and the second thickness thereof, and a border portion having the second thickness that overlaps with a perimeter of the radome adjacent an edge of the opening and confines the radome within the enclosure.

21. The antenna structure of claim 17, wherein the radiating element comprises a European Telecommunications Standards Institute (ETSI) Class 3 or Class 4 microwave antenna.

22. An antenna enclosure, comprising:

a plurality of sidewall surfaces configured to house a flat panel antenna element therein;

a mounting interface configured to accept mounting hardware that secures the antenna enclosure to external telecommunications equipment; and a front face configured to be positioned adjacent a surface of the flat panel antenna element, the front face comprising an internal surface that is bounded by the sidewall surfaces, and an external surface opposite the internal surface, wherein the front face comprises a first thickness adjacent the sidewall surfaces and a second thickness adjacent the surface of the flat panel antenna element, wherein the first thickness is greater than the second thickness.

* * * * *